US010793399B2

(12) United States Patent
Lawrence et al.

(10) Patent No.: US 10,793,399 B2
(45) Date of Patent: Oct. 6, 2020

(54) GIRDER BEAM INSTALLATION AND REMOVAL SYSTEM AND METHOD

(71) Applicant: Konecranes Global Corporation, Hyvinkää (FI)

(72) Inventors: Steve Lawrence, Waukesha, WI (US); Cory Wotachek, Greenfield, WI (US)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 205 days.

(21) Appl. No.: 15/908,357

(22) Filed: Feb. 28, 2018

(65) Prior Publication Data

US 2019/0263637 A1 Aug. 29, 2019

(51) Int. Cl.

| | |
|---|---|
| ***B66C 17/00*** | (2006.01) |
| ***B66C 23/26*** | (2006.01) |
| ***B66C 1/10*** | (2006.01) |
| ***B66C 11/10*** | (2006.01) |

(52) U.S. Cl.

CPC ..... *B66C 17/00* (2013.01); *B66C 1/105* (2013.01); *B66C 11/10* (2013.01); *B66C 23/26* (2013.01)

(58) Field of Classification Search

CPC ..... B66C 17/00; B66C 17/06; B66C 19/00; B66C 19/002; B66C 19/005; B66C 19/007; B66C 23/26; B66C 1/105; B66C 11/10

See application file for complete search history.

(56) References Cited

U.S. PATENT DOCUMENTS

| | | | | |
|---|---|---|---|---|
| 3,190,456 A * | 6/1965 | Holt | F16G 13/16 | 212/307 |
| 5,056,671 A * | 10/1991 | Thorsen | B66C 9/16 | 105/163.2 |
| 5,133,465 A * | 7/1992 | Kalan | B66C 13/22 | 212/276 |
| 5,791,257 A * | 8/1998 | Konop | B66C 9/08 | 105/163.1 |

(Continued)

FOREIGN PATENT DOCUMENTS

| | | |
|---|---|---|
| AT | 376631 B | 12/1984 |
| CN | 203007850 U | 6/2013 |
| WO | 2007059260 A2 | 5/2007 |

OTHER PUBLICATIONS

European Patent Office Extended Search Report for Application No. 19159693.1 dated Jul. 23, 2019 (6 pages).

*Primary Examiner* — Michael R Mansen
*Assistant Examiner* — Juan J Campos, Jr.
(74) *Attorney, Agent, or Firm* — Michael Best & Friedrich LLP

(57) ABSTRACT

An installation jib for a girder beam installation and removal system includes a main body having a first end and a second, opposite end, the main body extending along a longitudinal axis between the first end and the second end. The installation jib further includes a first sub-frame element coupled to the main body, a first roller coupled to the first sub-frame element, a second sub-frame element coupled to the main body, and a second roller coupled to the second sub-frame element. The first sub-frame element and the second sub-frame element are spaced longitudinally apart from one another, and the first roller and the second roller each are configured to rotate about an axis that is parallel to the longitudinal axis.

17 Claims, 29 Drawing Sheets

(56) References Cited

U.S. PATENT DOCUMENTS

| | | | | |
|---|---|---|---|---|
| 5,950,297 | A * | 9/1999 | Baker | B66C 9/10<br>248/669 |
| 2002/0179560 | A1* | 12/2002 | Plass | B66C 9/16<br>212/312 |
| 2012/0325765 | A1* | 12/2012 | Meyer | B66C 1/10<br>212/324 |

* cited by examiner

GIRDER BEAM INSTALLATION AND REMOVAL SYSTEM AND METHOD

FIELD OF INVENTION

The present invention relates to girder beams, and in particular to a system and method for installing new overhead crane girder beams and other components, and for removing existing girder beams or removing and installing other components related to an overhead crane system.

BACKGROUND

Girder beams are commonly used in overhead cranes within a warehouse or other industrial setting. The girder beams support trolleys. The trolleys move along the girder beams and are coupled to hoists that raise and lower equipment (e.g., nuclear equipment, turbine components). The girder beams and trolleys move the equipment from one area of the warehouse to another. Some warehouses or other industrial settings, particularly in the nuclear industry, have limited floor space (e.g., due to equipment or other materials taking up much of the floor space, and/or because some of the floor space is dedicated to pools). Additionally, what floor space is available may be limited not only in size, but also in stability (e.g., only be able to support a particular floor load). Thus, large-scale equipment such as mobile cranes, etc. may be over-sized and overweight for use directly on the floor space available inside of a warehouse or other industrial setting.

SUMMARY

In one construction, the invention provides an installation jib for a girder beam removal system. The installation jib includes a main body having a first end and a second, opposite end, the main body extending along a longitudinal axis between the first end and the second end. The installation jib further includes a first sub-frame element coupled to the main body, a first roller coupled to the first sub-frame element, a second sub-frame element coupled to the main body, and a second roller coupled to the second sub-frame element. The first sub-frame element and the second sub-frame element are spaced longitudinally apart from one another, and the first roller and the second roller each are configured to rotate about an axis that is parallel to the longitudinal axis.

In another construction, the invention provides an installation jib for a girder beam removal system. The installation jib includes an elongate main body having a first end and a second, opposite end, the main body extending along a longitudinal axis between the first end and the second end. The installation jib further includes a plurality of sub-frame elements and rollers coupled to the main body between the first end and the second end, each of the sub-frame elements including at least one roller. The installation jib further includes a prime mover coupled to the second end, and a lift block coupled to both the first end and to the prime mover.

In another construction, the invention provides a girder removal system. The girder removal system includes an installation jib having an elongate main body including a first end and a second, opposite end, the main body extending along a longitudinal axis between the first end and the second end. The installation jib further including at least one sub-frame element extending from the main body and at least one roller coupled to the sub-frame element. The girder removal system further includes a cradle coupled to the installation jib. The cradle includes at least one frame element configured to support an object to be lifted by the installation jib.

Other aspects of the invention will become apparent by consideration of the detailed description and accompanying drawings.

Figure 1:
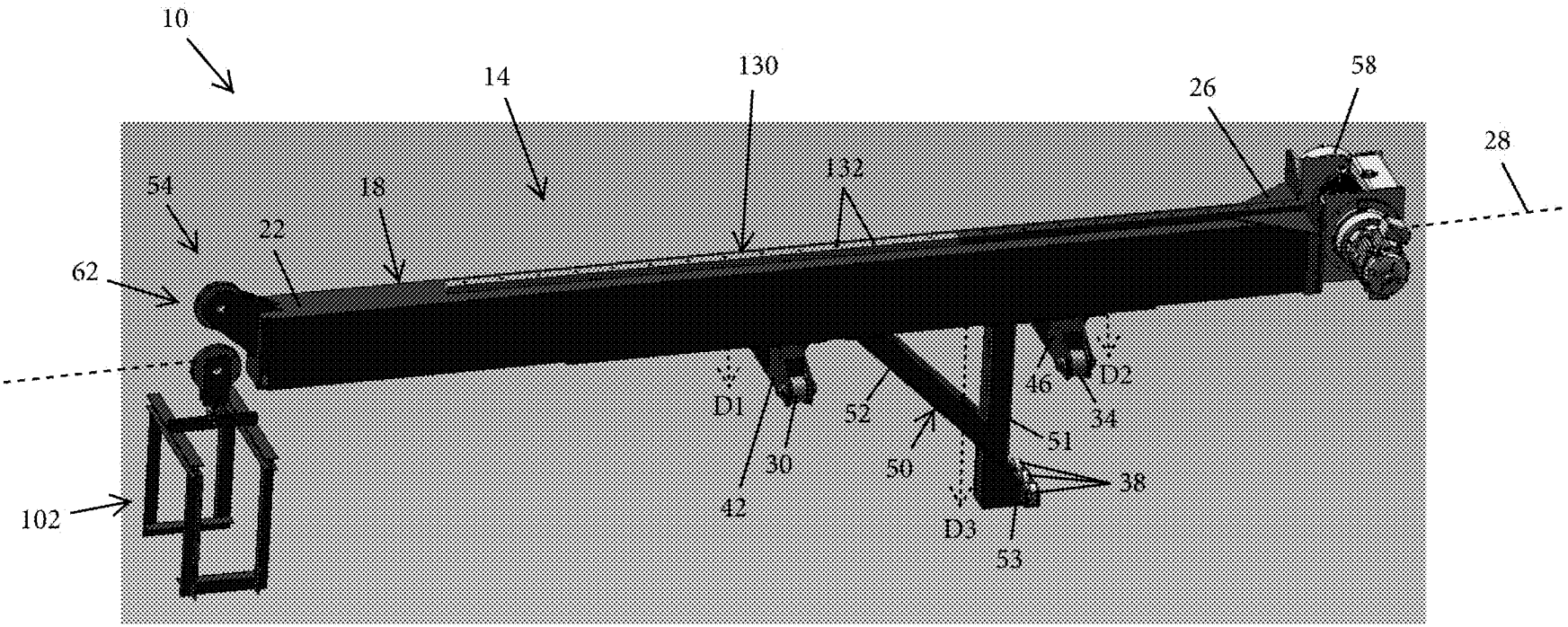
FIGS. 1 and 2 are perspective views of an installation jib of a girder removal system according to one construction.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-25 illustrate a girder removal system 10. While the girder removal system 10 is described in the context of removing and installing girder beams in a warehouse or other industrial setting, the girder removal system 10 may be used to lift and/or otherwise move components other than girder beams (e.g., tooling), and/or to lift or otherwise move girder beams or other components in environments other than a warehouse or other industrial setting.

With reference to FIGS. 1-7, the girder removal system 10 includes an installation jib 14. In the illustrated construction, the installation jib 14 includes a main body 18 having a first end 22 and a second, opposite end 26. The main body 18 extends along an elongated (e.g., longitudinal) axis 28 (FIG. 1) between the first end 22 and the second end 26. The main body 18 is a single elongate beam, although in other constructions the main body 18 has a shape and/or size other than that illustrated. For example, in some constructions, the main body 18 includes two elongate beams coupled together, or includes a truss, lattice, or other framework of beams or other structural members coupled together. In some constructions, the main body 18 includes a first beam and a second, telescoping beam that moves relative to the first beam, so that an overall length of the main body 18 is adjustable. Other constructions include various other numbers of telescoping components, or interlocking components, that permit adjustment of the installation jib 14. In the illustrated construction, the main body 18 extends approximately 15 feet in length between the first end 22 and the second end 26. In other constructions, the main body 18 extends at least 5 feet, at least 10 feet, at least 20 feet, or at least 25 feet. Other constructions include different lengths. Additionally, in the illustrated construction, the main body 18 is formed at least partially of steel or other metal, although in other constructions the main body 18 is formed of different materials.

With reference to FIGS. 1-4, the installation jib 14 includes girder beam contact elements sized and shaped to contact a girder beam and to both secure the installation jib 14 to the girder beam and facilitate sliding of the installation jib 14 along the one girder beam. In the illustrated construction, the installation jib 14 includes girder beam contact elements, including a first set of rollers 30, a second set of rollers 34, and a third set of rollers 38. As described further herein, the rollers 30, 34, 38 are each sized and shaped to contact various girder beams and to roll along the girder beams.

With continued reference to FIGS. 1-4, the first set of rollers 30 are rotatably coupled to a first sub-frame element 42. The first sub-frame element 42 is coupled (e.g., with bolts or other fasteners) to the main body 18. As illustrated in FIG. 1, the first sub-frame element 42 extends downward (or otherwise away) a first distance D1 from the elongated axis 28. In some constructions, the first sub-frame element 42 is a separate element that is removably coupled to the main body 18. In other constructions, the first sub-frame element 42 is integrally formed as a single piece with the main body 18. In some constructions, the first sub-frame element 42 is pivotally coupled (e.g., with a hinge or other element) to the main body 18 and is movable from a first position (e.g., away from and/or out of contact with a girder beam) to a second position (e.g., in close proximity to and/or in contact with the girder beam). The first set of rollers 30 includes two rollers 30, each disposed on opposite ends of the first sub-frame element 42. Each of the rollers 30 rotates about an axis that is parallel to the elongated axis 28.

The second set of rollers 34 are rotatably coupled to a second sub-frame element 46, which is coupled (e.g., with bolts or other fasteners) to the main body 18, and spaced from the first sub-frame element 42. As illustrated in FIG. 1, the second sub-frame element 46 extends downward (or otherwise away) a second distance D2 from the elongated axis 28. In the illustrated construction, the second sub-frame element 46 has an identical size and shape to that of the first sub-frame element 42, and the distance D1 is equivalent to the distance D2. In some constructions, the second sub-frame element 46 is removably coupled to the main body 18. In some constructions, the second sub-frame element 46 is integrally formed as a single piece with the main body 18. In some constructions, the second sub-frame element 46 is pivotally coupled (e.g., with a hinge or other element) to the main body 18, and is movable from a first position (e.g., out of contact with a girder beam) to a second position (e.g., in contact with the girder beam). The second set of rollers 34 includes two rollers 38, each rotating about an axis that is parallel to the elongated axis 28. In the illustrated construction, the second set of rollers 34 rotate about the same axes as the rollers 30.

The third set of rollers 38 are rotatably coupled to a third sub-frame element 50, which is coupled (e.g., with bolts or other fasteners) to the main body 18. As illustrated in FIG. 1, the third sub-frame element 50 extends downward (or otherwise away) a third distance D3 from the elongated axis 28. The distance D3 is greater than the distance D1 and the distance D2. The third sub-frame element 50 is disposed between the first sub-frame element 42 and the second sub-frame element 46. In some constructions, the third sub-frame element 50 is removably coupled to the main body 18. In other constructions, the third sub-frame element 50 is integrally formed as a single piece with the main body 18. In the illustrated construction, the third sub-frame element 50 defines a triangular-shaped truss structure or support arm that stabilizes the installation jib 14 on a girder beam, and inhibits or prevents rotation of the installation jib 14 relative to the girder beam in at least one direction. As illustrated in FIG. 1, the third sub-frame element 50 includes a first member 51 that extends away from the main body 18 and perpendicular to the elongated axis 28, a second member 52 that extends away from the main body 18 at an oblique angle to the elongated axis 28 and contacts the first member 51, and a third member 53 that extends away from the first member 51 and parallel to the elongated axis 28. The third set of rollers 38 are coupled to the third member 53. The third set of roller 38 includes three rollers 38, each rotating about an axis that is parallel to the elongated axis 28. In some constructions, the third sub-frame element 50 is pivotally coupled (e.g., with a hinge or other element) to the main body 18, and is movable from a first position (e.g., out of contact with a bottom of a girder beam) to a second position (e.g., in contact with the bottom of the girder beam). When in the second position (FIG. 1), the third set of rollers 38 are positioned below (e.g., directly below along an axis perpendicular to the elongated axis 28) the second set of rollers 34 (e.g., such that the second set of rollers 34 may be in contact with a top of a girder beam and the third set of rollers 38 may be in contact with a bottom of a girder beam, as described further herein).

Other constructions include various other arrangements of girder beam contact elements and/or sub-frame elements that support the girder beam contact elements. For example, in some constructions, one or more of the rollers 30, 34, 38 are replaced with a bearing element (e.g., ball bearing) or other low-friction surface or structure that facilitates sliding of the installation jib 14 over a girder beam. In some constructions, one or more of the sub-frames 42, 46, 50 has a different shape and/or size other than that illustrated, and/or includes a telescoping element or other adjustment element that permits adjustment of the overall height of the sub-frame. For example, the second sub-frame element 46 may be adjustable in height, such that the three rollers 34 may be moved closer to or farther away from the main body 18 (i.e., allowing for different sized girder beams to be fitted between the second set of rollers 34 and the main body 18 and/or to permit tightening of the second set of rollers 34 against a girder beam that is disposed between the second set of rollers 34 and the main body 18).

In some constructions, one or more of the rollers 30, 34, 38 has a different shape and/or size than that illustrated, or is made of a different material. For example, in some constructions, the first set of rollers 30 may be larger than the second set of rollers 34, or may be made of a different material than the second set of rollers 34. Additionally, some constructions include different numbers of rollers 30, 34, 38 than that illustrated, and/or different numbers of sub-frame elements 42, 46, 50 than that illustrated. For example, in some constructions, the first sub-frame element 42 and the third sub-frame element 50 are omitted, and the first and third sets of rollers 30, 38 are rotatably coupled directly to the main body 18.

With continued reference to FIGS. 1, 2, and 5-7, the installation jib 14 further includes a lift assembly 54. The lift assembly 54 is used, for example, to lift a component (e.g., a girder beam, tooling, trolley, crane controls, crane end trucks, crane runway components, or other components). In the illustrated construction, the lift assembly 54 includes a prime mover 58 coupled to the second end 26 of the main body 18. The prime mover 58 is an electric winch, although other constructions include different types of prime movers 58, including hydraulic actuators, strand jacks, etc. While the prime mover 58 is coupled to the second end 26, in other constructions the prime mover 58 is coupled to the first end 22, or to a location between the first and second ends 22, 26.

Figure 5:
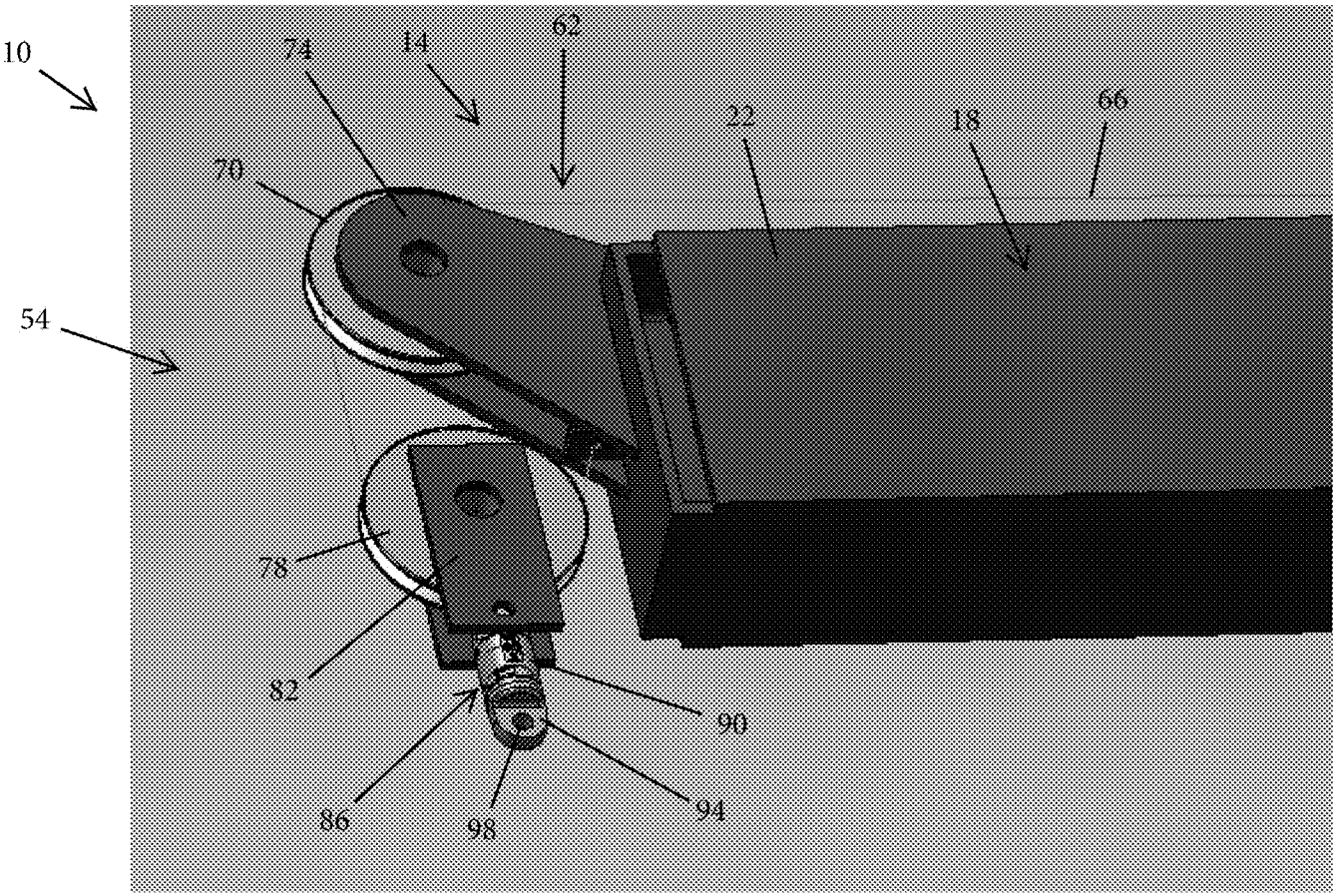
FIGS. 5-7 are enlarged, partial perspective views of a lift assembly of the installation jib.

The lift assembly 54 further includes a lift block 62, and a line 66 (e.g., wire, rope, chain, etc., as seen in FIG. 5) extending from the prime mover 58 to the lift block 62. In the illustrated construction, at least a portion of the lift block 62 is coupled to the first end 22 of the main body 18, and is integrally formed as a single piece with the main body 18. In other constructions, the lift block 62 is entirely a separate element from the main body 18, is removably coupled to the main body 18, and/or is movable along the main body 18 (e.g., via rails, etc.). In some constructions, and as described further below, the lift block 62 is part of a mast on the installation jib 14 that telescopes or otherwise moves relative to the main body 18.

As illustrated in FIG. 5, the lift block 62 includes a first pulley 70 rotatably coupled to a first pulley support 74, and a second pulley 78 rotatably coupled to a second pulley support 82. The first and second pulleys 70, 78 rotate about axes that extend parallel to one another. The first pulley support 74 extends directly from and is integrally formed as a single piece with the first end 22 of the main body 18, and the second pulley support 82 is spaced from both the first pulley support 74 and the first end 22. The line 66 extends over the first pulley 70, wraps around the second pulley 78, and is coupled (e.g., fixed) to the first pulley support 74, such that the second pulley 78 and the second pulley support 82 are movable (e.g. vertically) together relative to the first pulley 70 and the first pulley support 74, as well as relative to the main body 18 when the prime mover 58 is activated.

Other constructions include different arrangements of pulleys, pulley supports, lines, and/or other structures that form a lift assembly 54 on the installation jib 14. For example, in some constructions, the lift assembly 54 includes only a single pulley 70. In some constructions, the lift assembly 54 includes a winch or other prime mover 58 at the first end 22 that raises and lowers a line 66, and does not include any pulleys.

With continued reference to FIG. 5, in the illustrated construction, the lift block 62 further includes a cradle attachment element 86 coupled to the second pulley support 82. The cradle attachment element 86 is a swivel element that includes a first housing 90 coupled directly to the second pulley support 82, and a second housing 94 rotatably coupled to the first housing 90 about an axis that is perpendicular to the axes of rotation of the first and second pulleys 70, 78. The second housing 94 includes an aperture 98 that is used to attach the second housing 94 to a cradle or other component. In other constructions, the cradle attachment element 86 is a hook, clamp, fastener, or other element that permits attachment of the lift block 62 to another component. In some constructions, the cradle attachment element 86 is removably coupled to the second pulley support 82.

Figure 6:
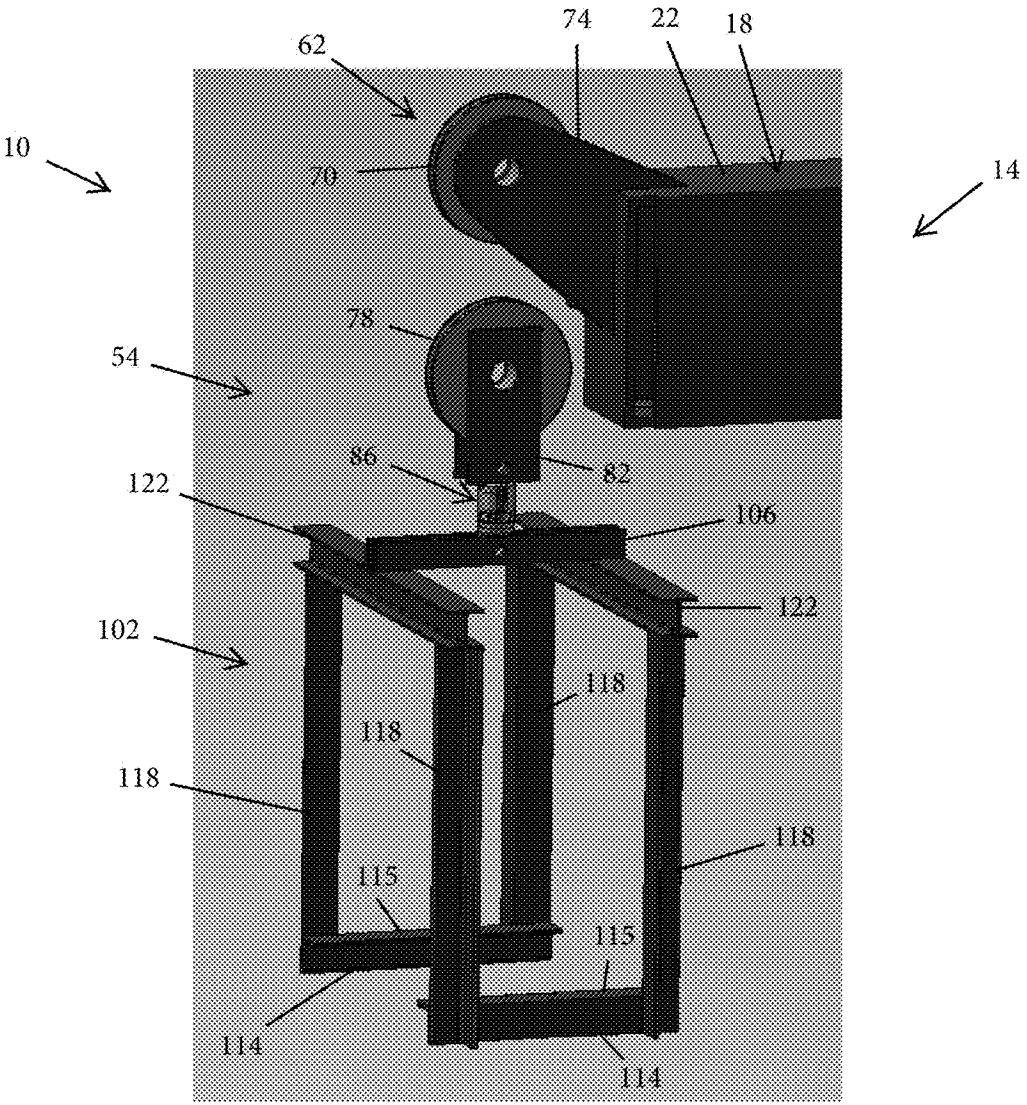
Figure 7:
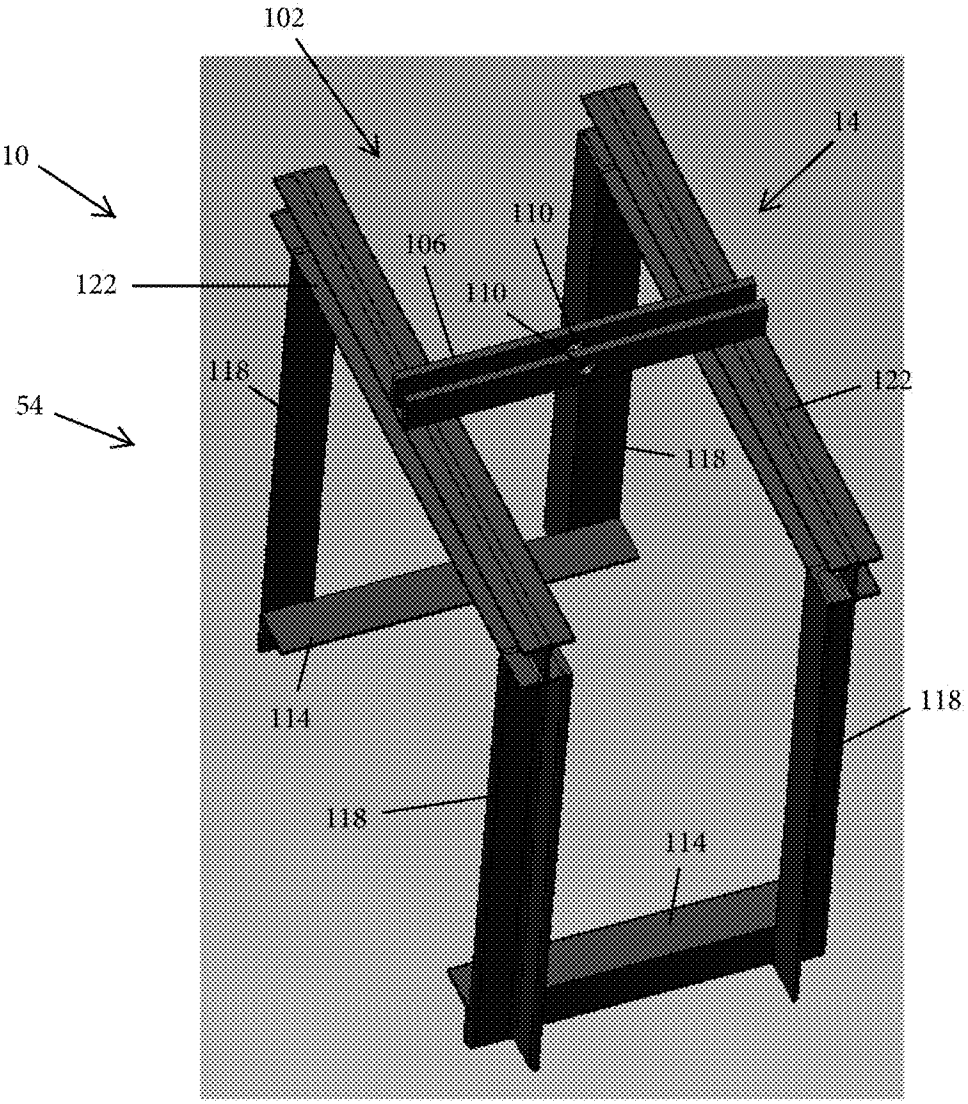
Figure 20:
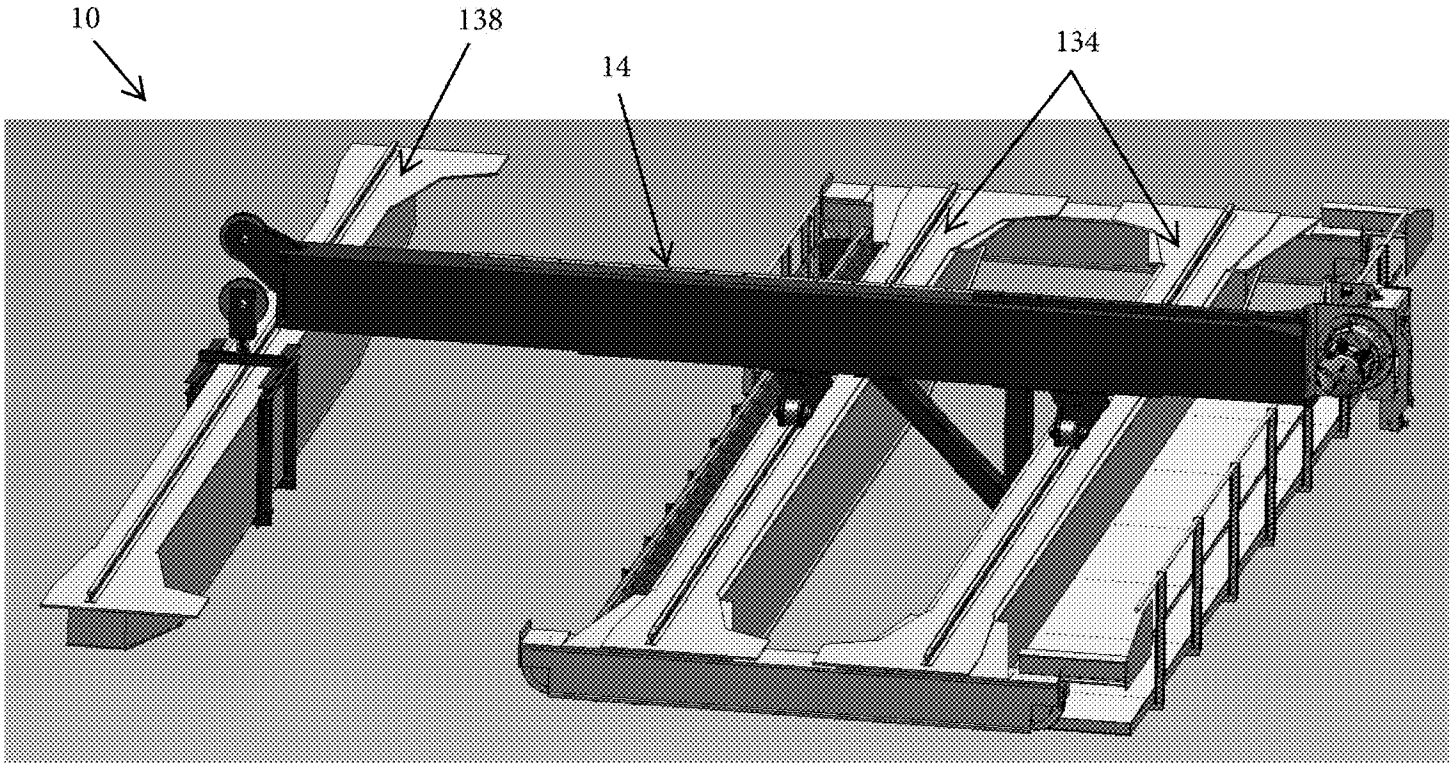

With reference to FIGS. 6 and 7, the installation jib 14 further includes a cradle 102 that is coupled to the lift block 62, and is sized and shaped to hold a girder beam or other element (see for example FIG. 20). The cradle 102 includes a first frame member 106 having apertures 110 that align with the aperture 98 on the cradle attachment element 86, such that a pin or other structure may be inserted through the apertures 98, 110 to releasably lock the cradle 102 to the cradle attachment element 86 and to the lift block 62. Other constructions include different frame members and/or structures (e.g., clamps, bolts, or other fasteners) for releasably locking the cradle 102 to the lift block 62. In some constructions, the cradle attachment element 86 is integrally formed as a single piece with the cradle 102, and the cradle attachment element 86 (and thereby the cradle 102) is removably coupled to the second pulley support 82.

With continued reference to FIGS. 6 and 7, the cradle 102 includes further frame members coupled to the first frame member 106. In the illustrated construction, the further frame members form a generally U-shaped structure or structures, and include lower frame members 114 with upper surfaces 115 that support a bottom of a girder beam from below, side frame members 118 that support, contact, and/or otherwise contain the girder beam from the sides, and upper frame members 122 that contact and/or contain the girder beam from above. In the illustrated construction, the first frame member 106 is coupled to the upper frame members 122.

In some constructions, one or more of the frame members of the cradle 102 are releasably coupled to one another, such that the frame members are first placed around a girder beam and are then coupled together to secure and/or enclose the girder beam. For example, in some constructions, one of the upper frame members 122, in combination with the two side frame members 118 that extend down from the upper frame member 122 and the two lower frame members 114 that extend away from bottoms of the side frame members 118, are placed around a girder beam. The other upper frame member 122 and the other two side frame members 118 extending down from the other upper frame member 122 are then placed on the other side of the girder beam. The other two side frame members 118 are coupled to the lower frame members 114 (e.g., with bolts or other fasteners). The first frame member 106 is then coupled to both of the upper frame members 122 (e.g., with bolts or other fasteners) to secure the entire frame structure of the cradle 102 around the girder beam or other element.

In some constructions the cradle 102 includes two U-shaped frame members that are releasably coupled together (e.g., with bolts or other fasteners) and that wrap around the girder beam or other element. In some constructions, the frame members of the cradle 102 include various adjustment apertures (e.g., for receipt of locking pins), or include telescoping elements, so that the frame members may be adjusted relative to one another to change an overall size of the cradle 102 (i.e., thus accommodating for different-sized girder beams or other elements). In yet other constructions, the cradle 102 includes one or more slings that fit around a bottom of a girder beam or other element to help secure and/or lift the girder beam or other element. Other constructions include various other combinations of frame element, slings, fasteners, and/or locking mechanisms (e.g., clamps, pins, etc.) that may be used to help secure an element such as a girder beam to the cradle 102. In some constructions, the cradle 102 and/or the installation jib 14 are used to raise elements other than girder beam (e.g., a trolley, a different beam, an actuator or motor, etc.).

Figure 2:
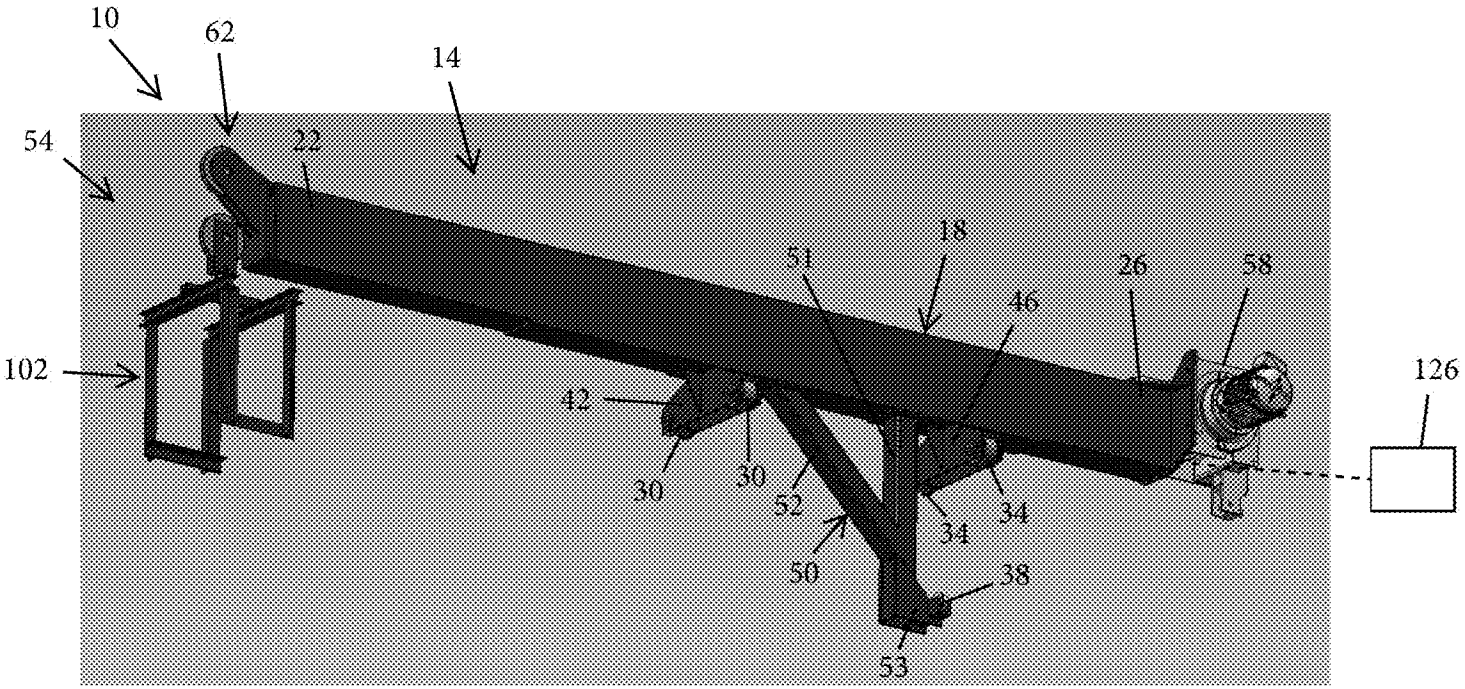
Figure 3:
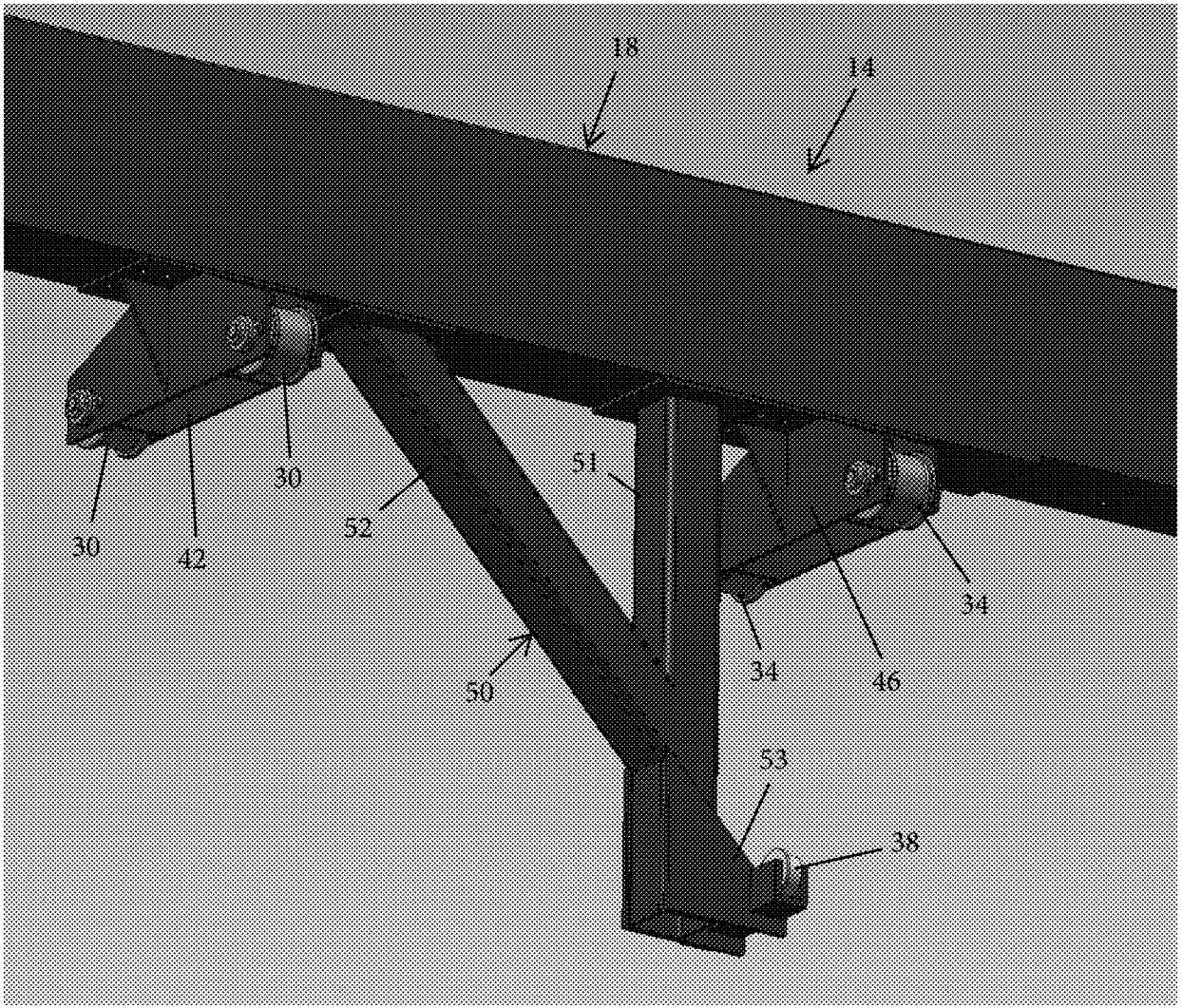
FIGS. 3 and 4 are enlarged, partial perspective views of girder contact elements of the installation jib.

With reference to FIGS. 1 and 2, in the illustrated constriction, the installation jib 14 has an 8 ton capacity (i.e., referring to the amount of weight that may be lifted with the installation jib 14 and its prime mover 58). In other constructions the installation jib 14 has a capacity less than 8 tons or larger than 8 tons (e.g., at least 10 tons, at least 12 tons, etc.).

With reference to FIG. 2, in some constructions, the installation jib 14 includes a counterweight structure 126 (illustrated schematically) to offset forces applied to the installation jib 14 during use of the installation jib 14. For example, in some constructions, the counterweight structure 126 includes a weight (e.g., block, etc.) that is coupled to the second end 26 of the main body 18, or to the prime mover 58. In some constructions, the counterweight structure 126 is movable relative to the main body 18 (e.g., may be moved or slid along rails or other structures toward or away from the main body 18 and toward or away from the lift block 62, to adjust a moment arm). In some constructions, the installation jib 14 includes a hoist, winch, or other structure that raises the counterweight structure 126 from a location within the building 154 when the counterweight structure 126 is desired). Other constructions include various other types and/or numbers of counterweight structures 126 than that illustrated, as well as other locations for a counterweight structure than that illustrated.

Figure 4:
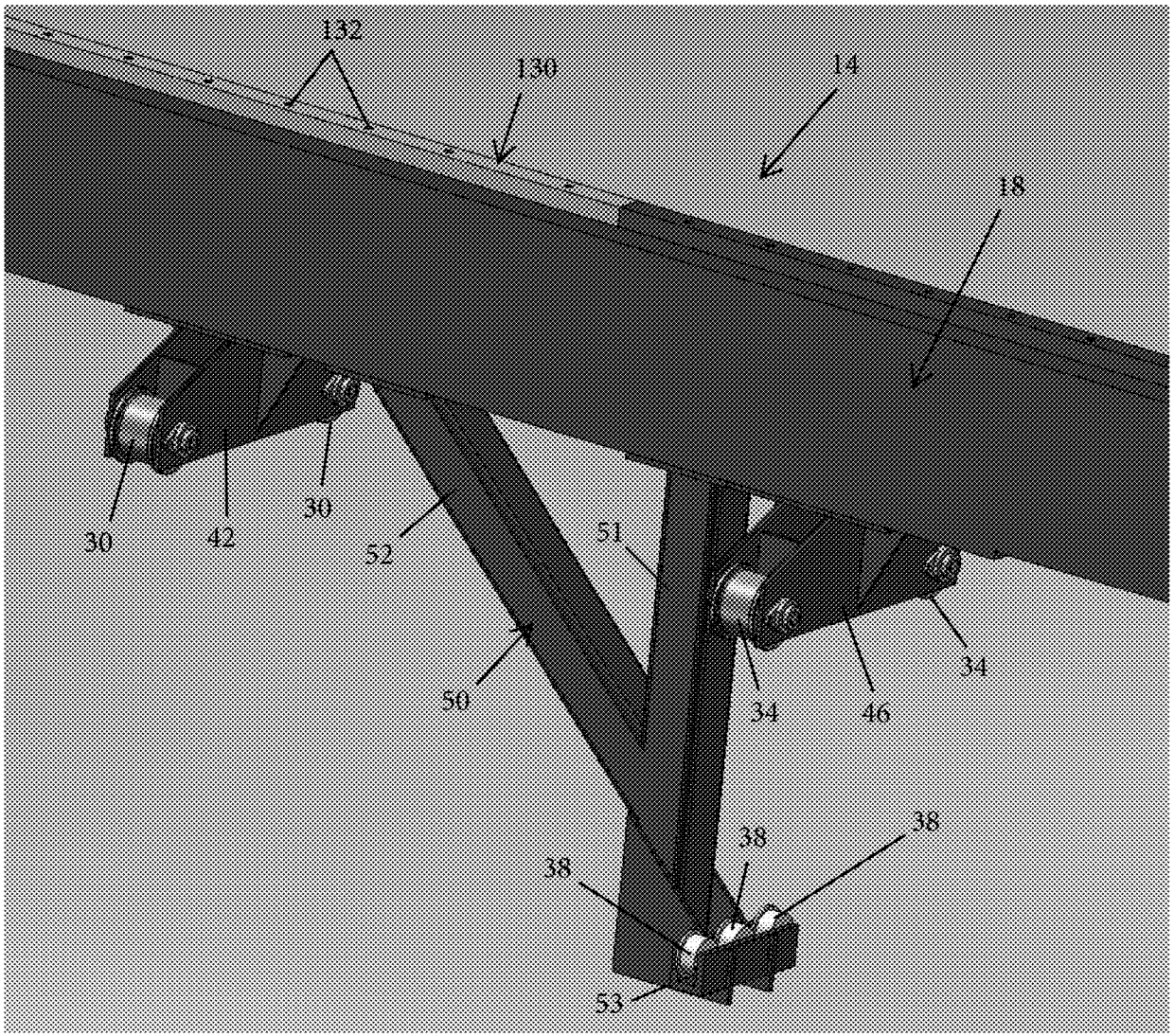

With reference to FIGS. 1 and 4, the installation jib 14 further includes a rigging attachment element 130. In the illustrated construction, the rigging attachment element 130 is an elongate protruding bar disposed along the main body 18 of the installation jib 14. The elongate protruding bar includes a series of apertures 132 that are sized and shaped to receive swivel hoists or other attachment structures (e.g., hooks or loops), so that the installation jib 14 as a whole may be raised, lowered, and/or swung or pivoted (e.g., with a rigging such as ropes, chains, etc.). Other constructions include different numbers and locations of rigging attachment elements 130 than that illustrated, as well as different types than that illustrated.

With reference to FIGS. 8-25, a process of using the girder removal system 10, and in particular of using the installation jib 14, is illustrated. In the illustrated construction, the process is used to remove existing girder beams 134 in a warehouse or other industrial setting, and to replace the existing girder beams 134 with new girder beams 138.

Figure 8:
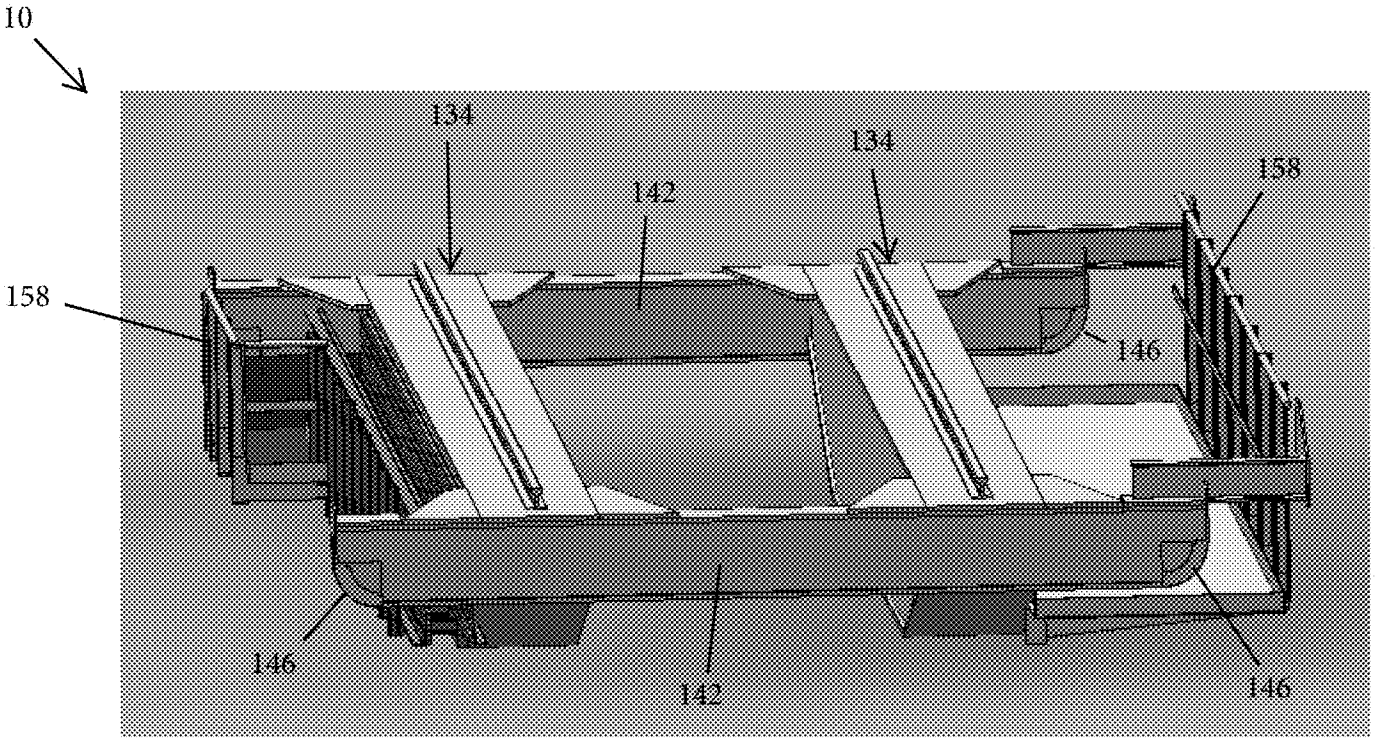
FIG. 8 is a perspective view of an existing set of girder beams to be removed by the girder removal system.
Figure 9:
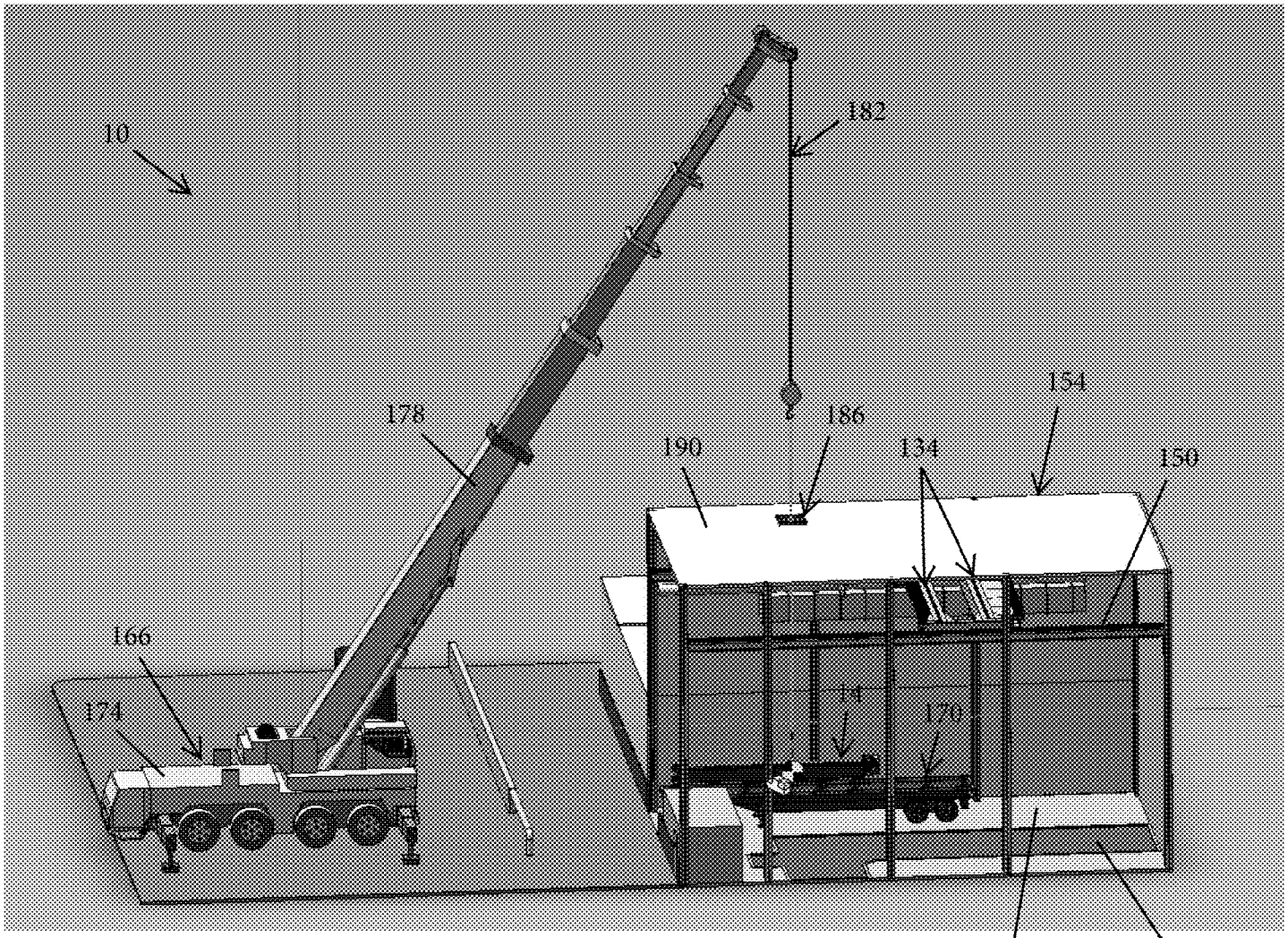
FIGS. 9-13 are perspective views of a process of lifting and assembling the installation jib onto the existing set of girder beams.

FIGS. 8-13 illustrate a set of existing girder beams 134. The existing girder beams 134 extend parallel to one another, and are coupled at respective ends to two existing end trucks 142 that each include rollers 146. The rollers 146 allow the girder beams 134 and the end trucks 142 to slide together linearly along rails 150 that are disposed within a building 154 (FIG. 9). As illustrated in FIG. 8, in some constructions, the girder beams 134 are coupled to walkways 158 that allow operators to walk back and forth alongside the girder beams 134.

While not illustrated, a trolley is typically coupled to the girder beams 134. The trolley moves or slides along the existing girder beams 134 (e.g., along a direction that extends between the two existing end trucks 142 and is perpendicular to the direction of the movement of the girder beams 134 on the rails 150). The trolley may be coupled, for example, to hoists that raise and lower equipment (e.g., nuclear equipment), so that the equipment may be raised, lowered, and/or translated along various directions based on movement of the trolley on the girder beams 134 and/or movement of the girder beams 134 themselves along the rails 150. In some constructions, the trolley is removed from the girder beams 134 before the installation jib 14 is attached.

With reference to FIGS. 9-13, 21, and 22, the process of replacing the existing girder beams 134 first begins by using one or more beam trolleys 163 (FIG. 22), or other crane or lifting mechanisms in the building 154, to raise new end trucks 162 (FIG. 21) for the new girder beams 138. The beam trolleys 163 are installed onto roof truss girders 164 (FIGS. 21 and 22), and move along the roof truss girders 164. The new end trucks 162 are lifted up with the beam trolleys 163 (e.g., with chain hoists coupled to the beam trolleys 163), and operators attach the new end trucks 162 to the rails 150 of the building 154 at a location spaced from the existing girder beams 134. In some constructions, the installation jib 14 (or a portion thereof) is able to rotate relative to the existing girder beam 134, thus being able to raise and/or install the new end trucks 162 and/or remove the existing end trucks 142. In some constructions, the beam trolleys 163 are used to raise components other than the end trucks 162 (e.g., the trolleys that ride along the girder beams 134).

Figure 10:
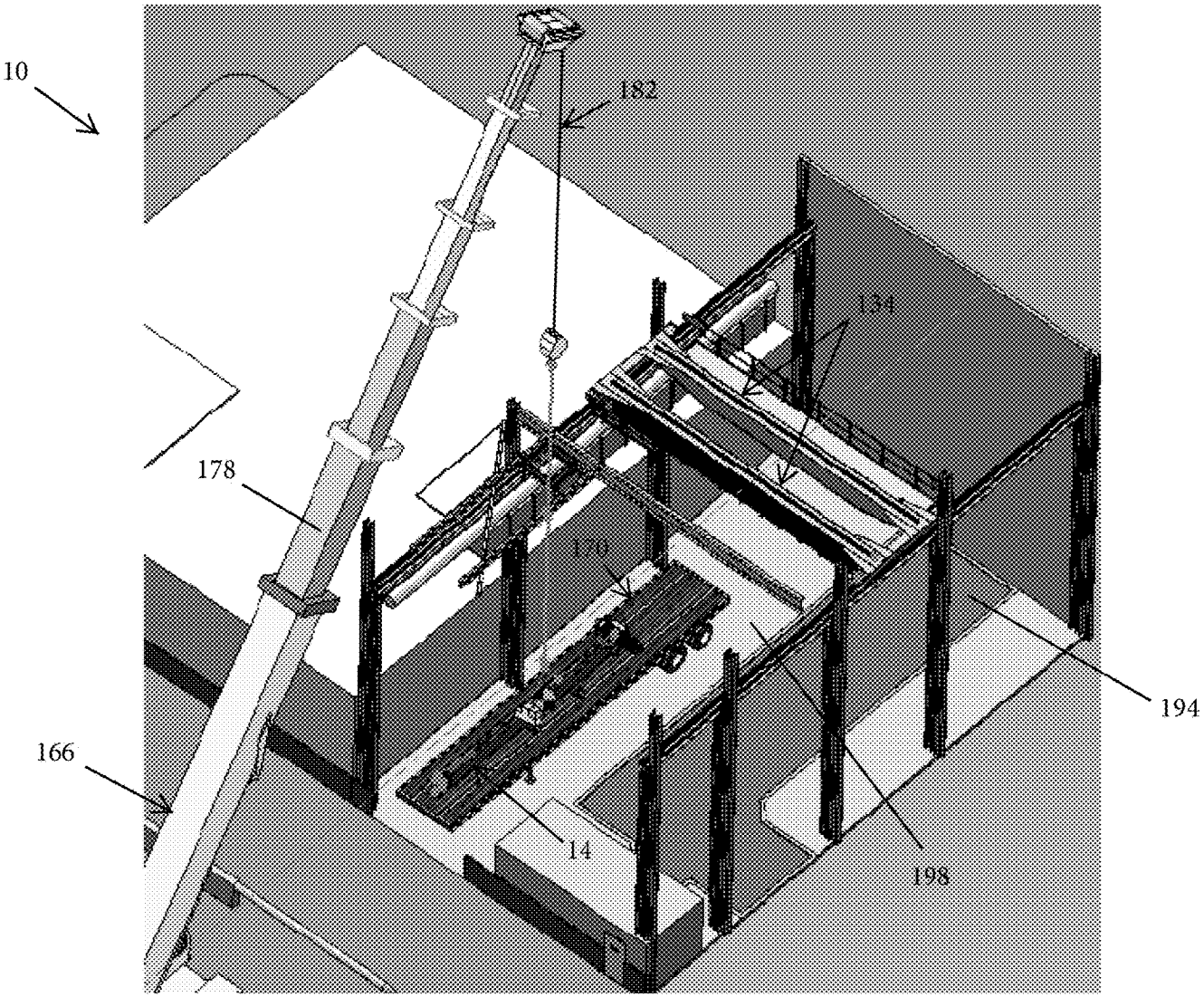
Figure 11:
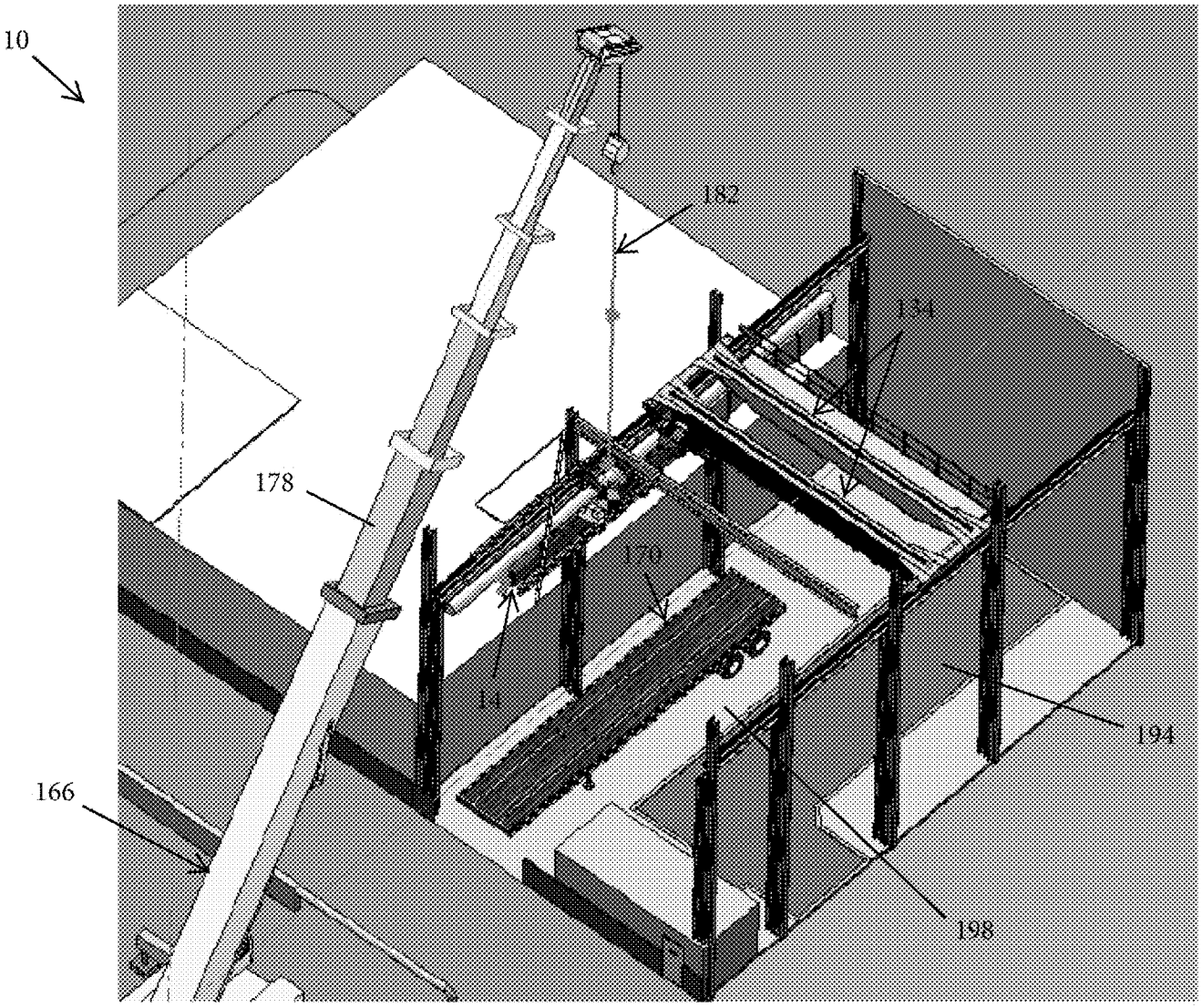

With reference to FIGS. 9-13, in the illustrated construction, a mobile crane 166 is moved into position adjacent the building 154, and the installation jib 14 is moved into the building 154 (e.g., on a vehicle 170 such as a flatbed truck as illustrated in FIGS. 9-11). The mobile crane 166 includes a base 174, a boom 178 extending from the base 174, and a rigging 182 extending from the boom 178. As illustrated in FIGS. 9-12, the rigging 182 includes a series of lines (e.g., ropes) that are lowered down through a hatch 186 on a roof 190 of the building 154. Once the rigging 182 is lowered through the hatch 186, the rigging 182 is then coupled to the installation jib 14. For example, in the illustrated construction, the rigging 182 is coupled to one or more of the rigging attachment elements 130 on the installation jib 14. In some constructions, the rigging 182 includes swivel hoists or other mechanisms that are coupled to the rigging attachment elements 130, and that permit a swiveling motion or rotation of the installation jib 14.

With reference to FIGS. 9-11, in the illustrated construction, the building 154 is a nuclear storage facility that includes a pool 194 and a ground surface 198 (e.g., flat surface) adjacent the pool 194. The hatch 186 is disposed directly above the ground surface 198, and directly above the vehicle 170 and the installation jib 14, so that when the rigging 182 is lowered through the hatch 186, the rigging 182 extends down directly to the installation jib 14, and the installation jib 14 may then be raised with the mobile crane 166. Other constructions include different types of cranes, booms, lines, riggings, or other mechanisms than that illustrated for raising the installation jib 14. For example, in some constructions the mobile crane 166 is replaced with an interior crane that includes a rigging that extends down and is coupled to the installation jib 14. The interior crane may be a permanent or movable crane (e.g., trolley crane).

Figure 12:
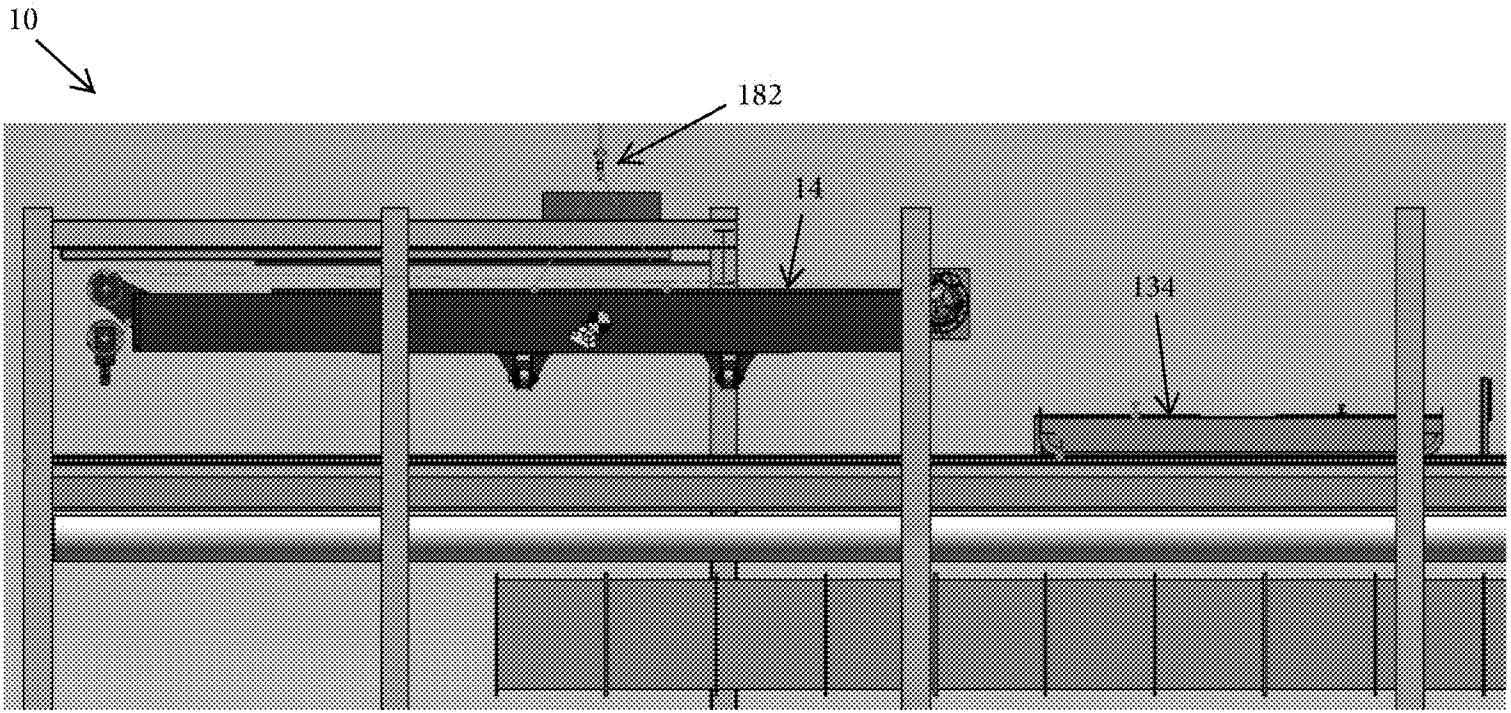
Figure 13:
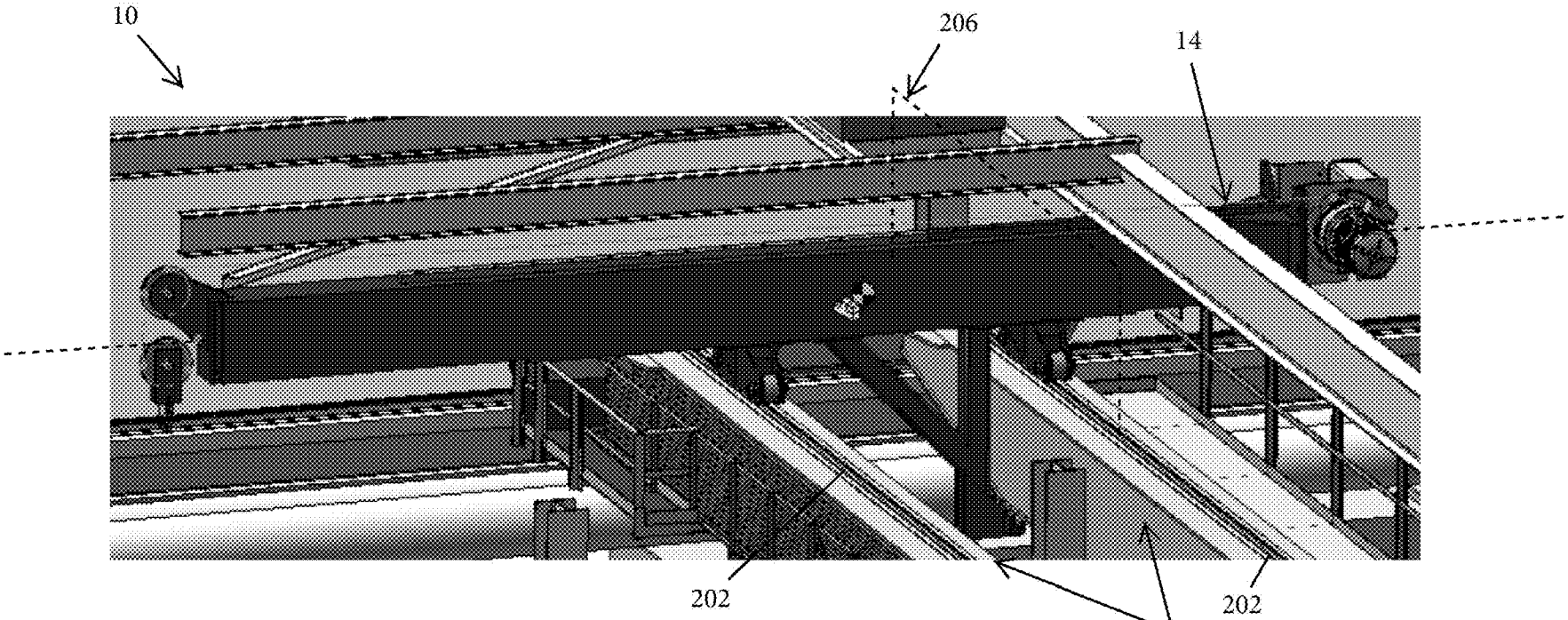

With reference to FIGS. 11-13, once the installation jib 14 has been fully raised (e.g., to a location that is adjacent the roof 190), the existing girder beams 134 are moved underneath the installation jib 14. For example, and as described above, the girder beams 134 include rollers 146 that ride along the rails 150 of the building 154. The girder beams 134 are thus pushed or pulled (e.g., manually with ropes and come-alongs, or via motors or other structures) along the rails 150, until the girder beams 134 are disposed below the installation jib 14. The installation jib 14 is then lowered down onto the existing girder beams 134 and installed on the girder beams 134 using the first and second sub-frame assemblies 42, 46 and the associated rollers 30, 34. In the illustrated construction, during this process the third sub-frame element 50 is not coupled to the main body 18. Thus, only the first sub-frame element 42 and the second sub-frame element 46 and the associated sets of rollers 30, 34 are coupled to the main body 18. When the installation jib 14 is lowered onto the girder beams 134, the first and second sets of rollers 30, 34 contact upper surfaces and/or rails 202 (FIG. 13) of the two girder beams 134, respectively.

Once the first and second sets of rollers 30, 34 are resting on the girder beams 134, the third sub-frame element 50 is then raised (e.g., with the mobile crane 166 or via another internal crane within the building 154). The third sub-frame element 50 is positioned around one of the girder beams 134, such that the third set of rollers 38 are in contact with a bottom surface and/or rail (not shown) on the girder beam 134, and the girder beam 134 is sandwiched between the rollers 34, 38. In some constructions, once the third sub-frame element 50 is coupled the main body 18, a plane 206 (FIG. 13) that is perpendicular to the elongated axis 28 passes through each of the second set of rollers 34 and the third set of rollers 38.

The third sub-frame element 50 is then coupled (e.g., bolted) onto the main body 18. In some constructions, the process of attaching the third sub-frame element 50 to the main body 18 is accomplished manually via an operator or operators that are standing on the walkways 158. As noted above, in some constructions the third sub-frame element 50 is adjustable, so that the third sub-frame element 50 may be expanded or contracted, and/or tightened or loosened, to fit onto a particular sized girder beam 134. In some constructions worm screws, clamps, or other tightening elements are used to adjust and tighten the rollers 38 against a bottom of the girder beam 134. Additionally, and as noted above, in some constructions the third sub-frame element 50 is already movably coupled (e.g., pivotally coupled) to the main body 18, and the process of attaching the installation jib 14 to the girder beam 134 includes rotating the third sub-frame element 50 and its third set of rollers 38 to a position where the third set of rollers 38 is in contact with the girder beam 134.

Figure 14:
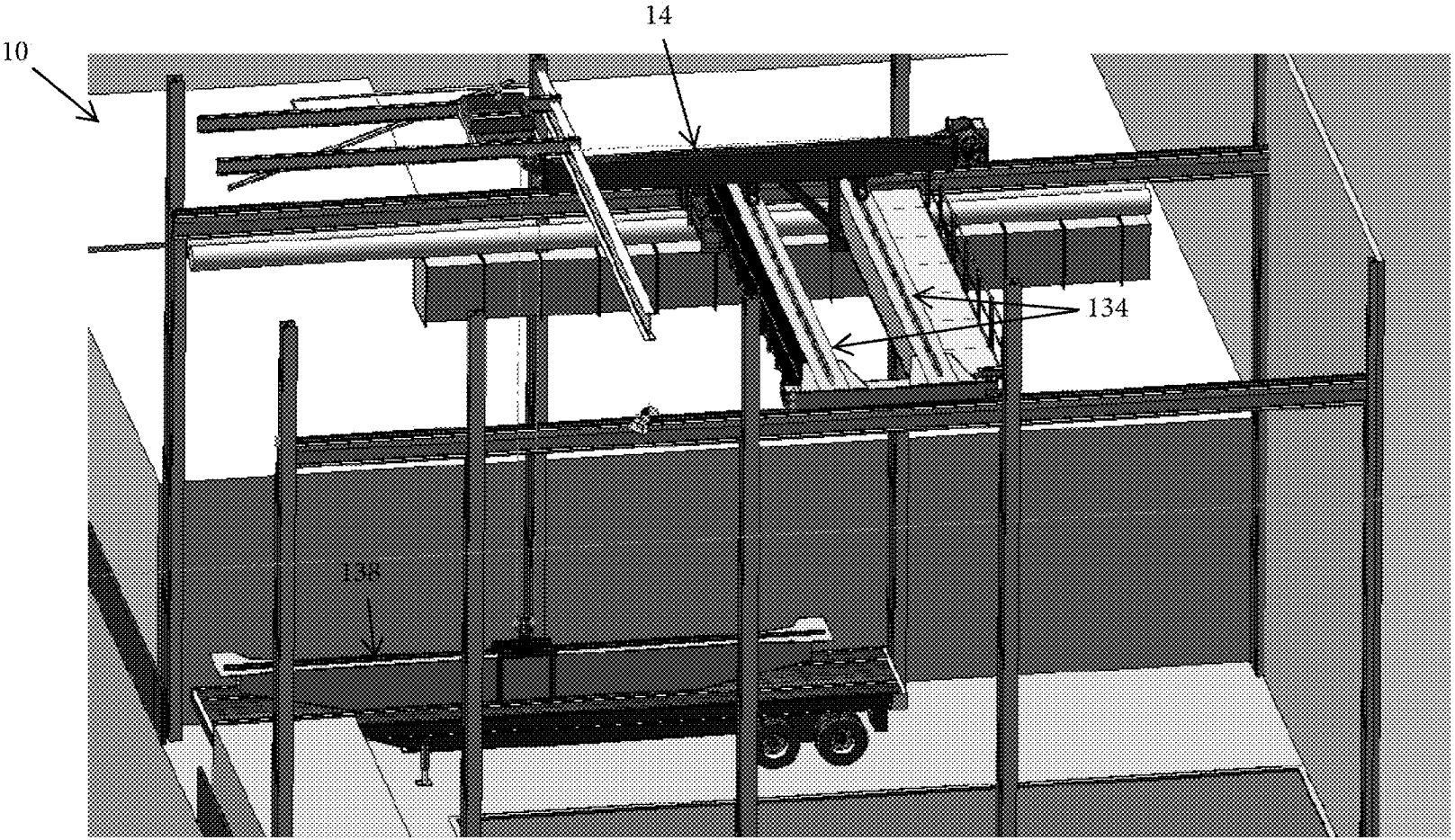
FIGS. 14-20 are perspective views of a process of lifting and positioning new girder beams with the installation jib.
Figure 15:
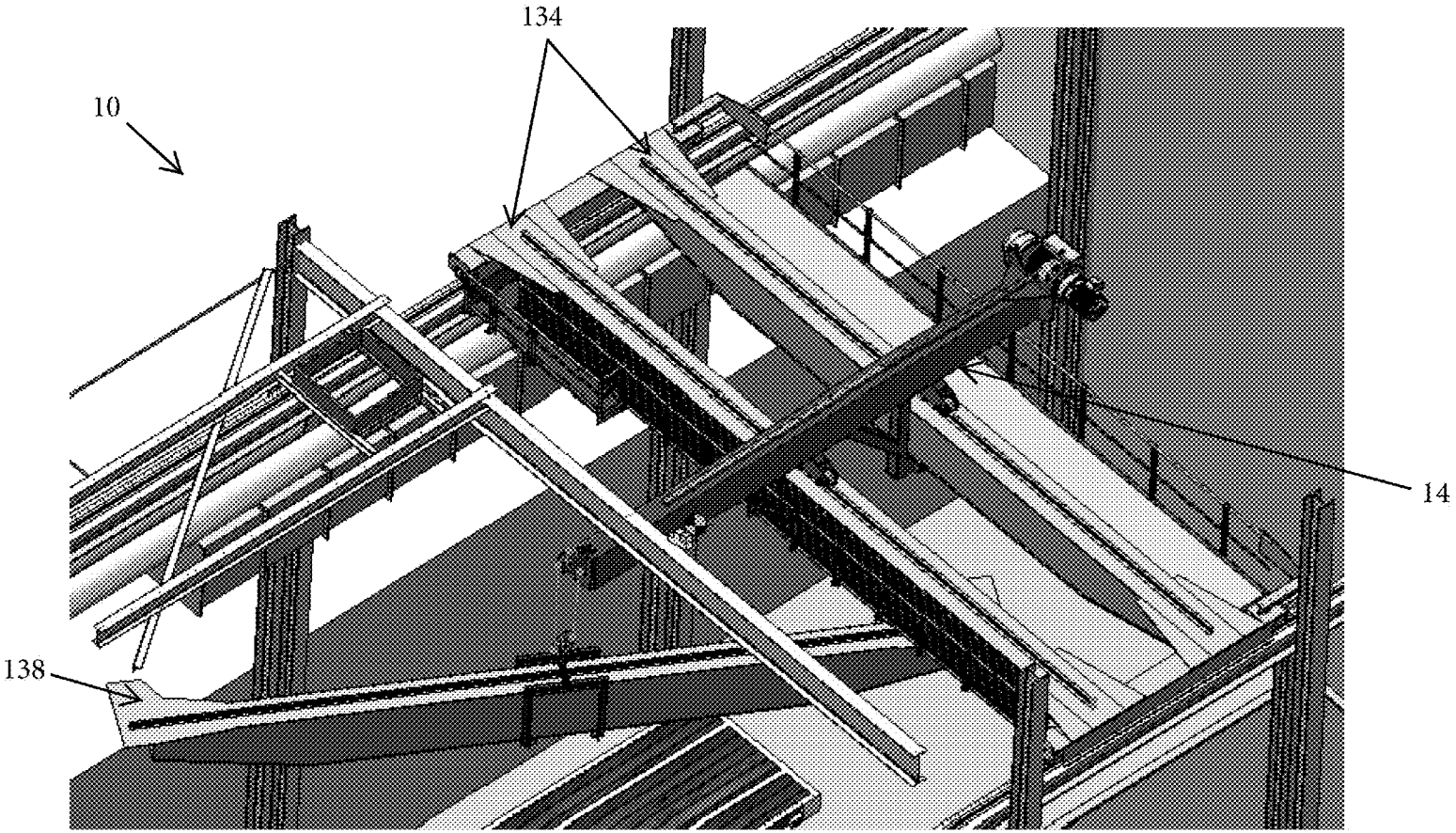
Figure 16:
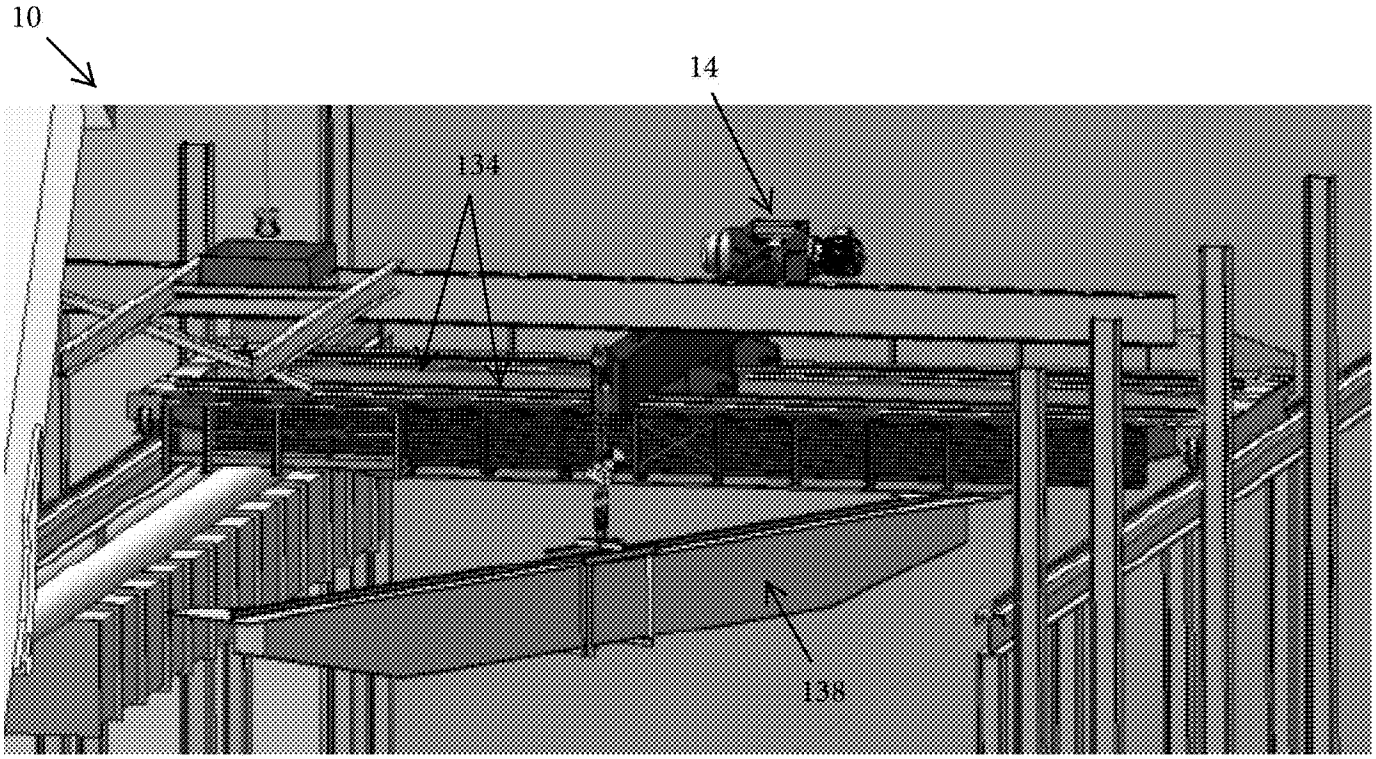
Figure 17:
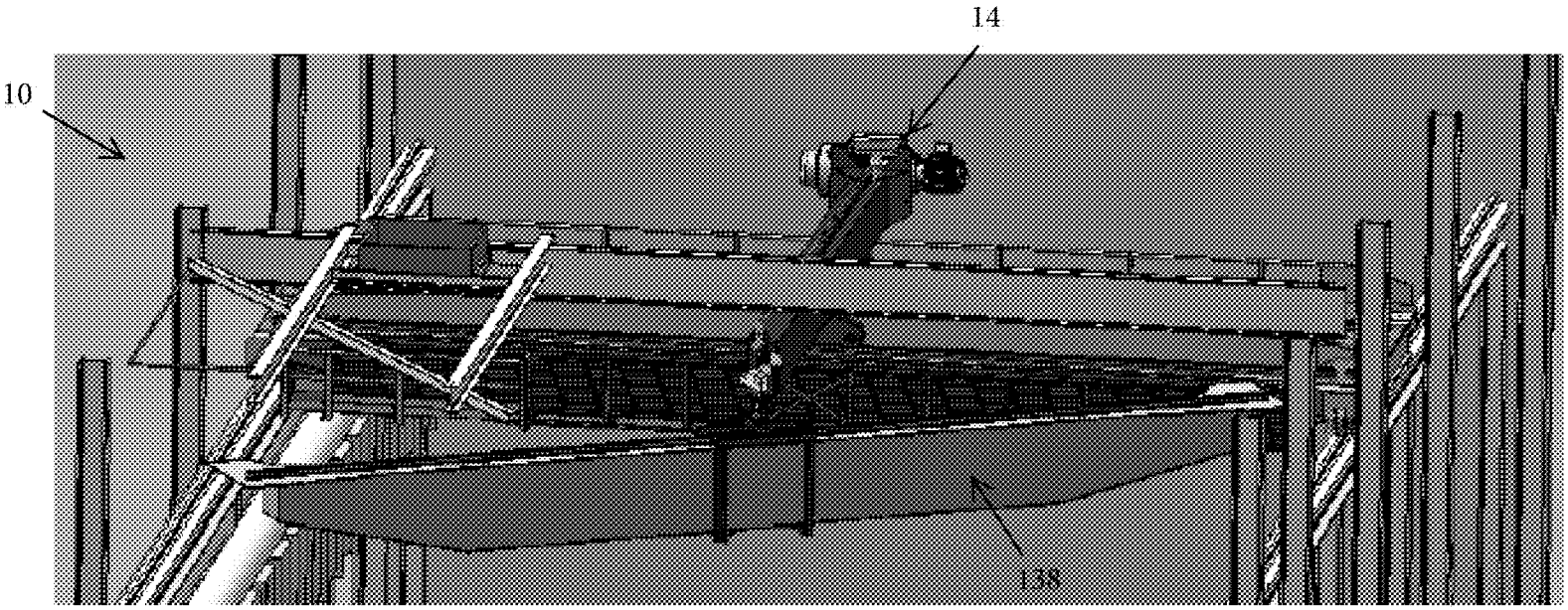
Figure 18:
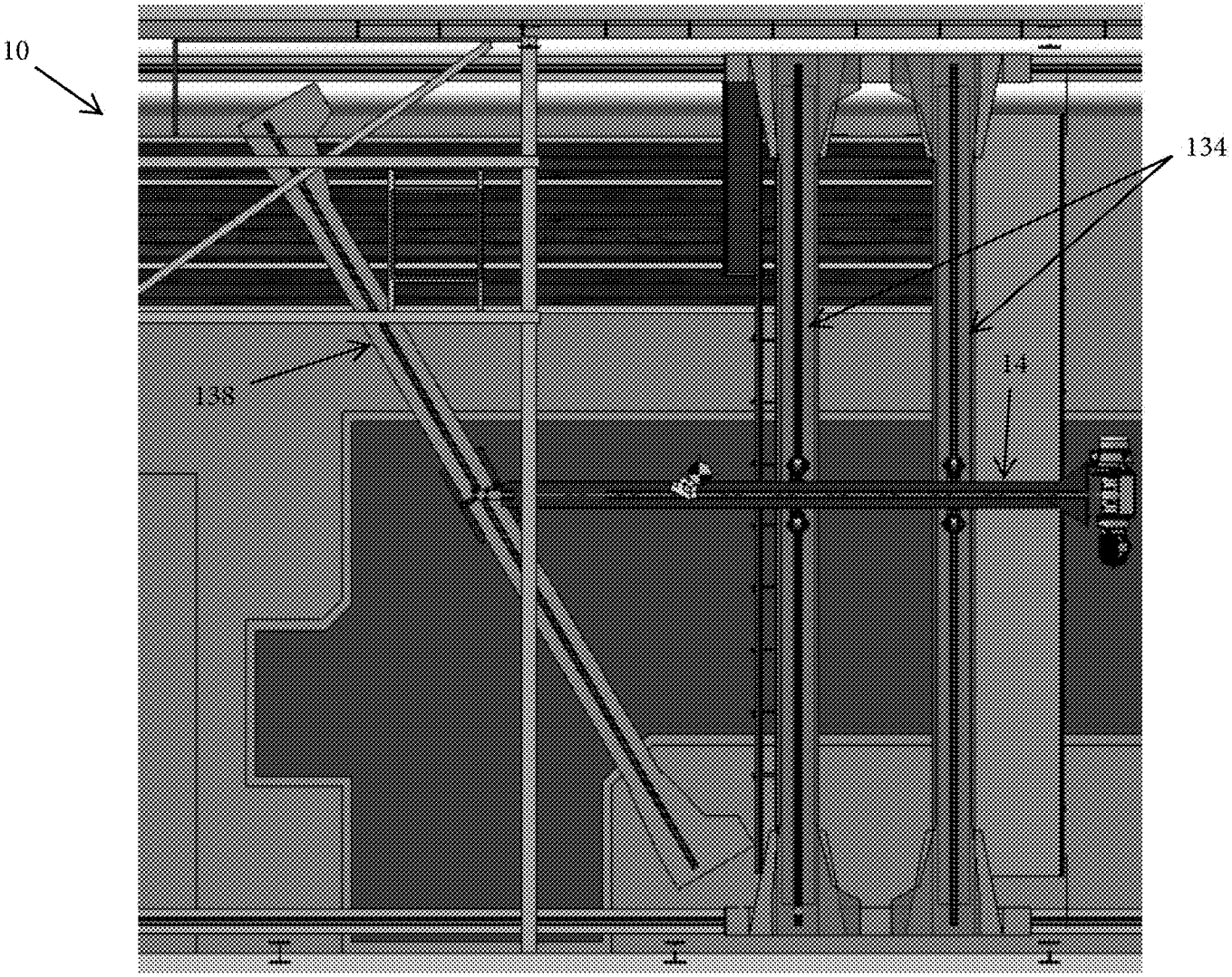
Figure 19:
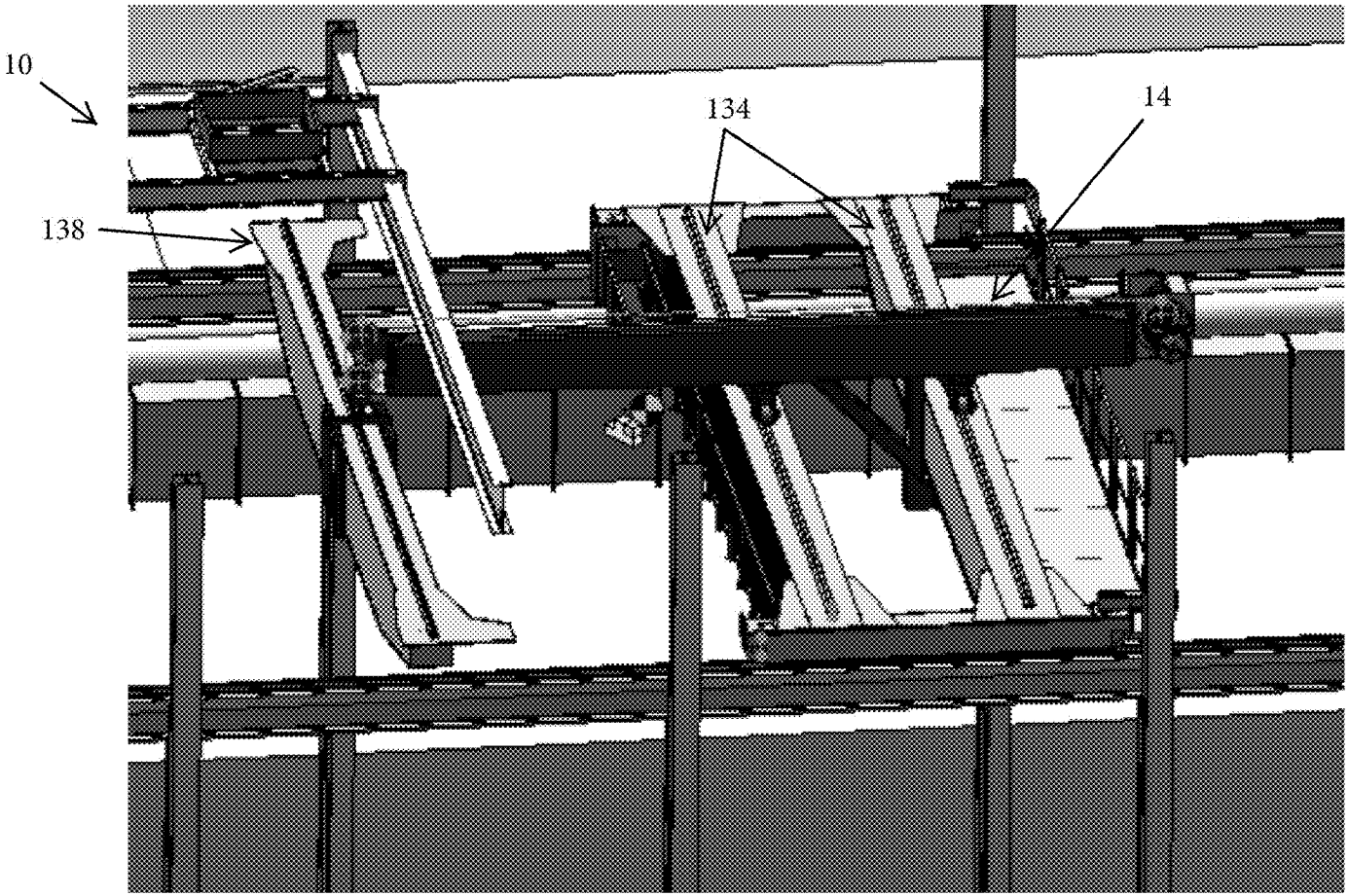

With reference to FIG. 14, once the installation jib 14 has been lowered onto the girder beams 134 and the second sub-frame element 46 has been coupled to the main body 18, the installation jib 14 and the girder beams 134 are moved away from the hatch 186 using the rollers 146 and the rails 150 in the building 154. As illustrated in FIG. 14, one of the new girder beams 138 is then delivered into the building 154 (e.g., on the same vehicle 170 or a different vehicle). Once the girder beam 138 is delivered, the lift assembly 54 then lowers the second pulley support 82 and the cradle attachment element 86 (e.g., via activation of the prime mover 58), until the cradle attachment element 86 is positioned directly above the girder beam 138. In some constructions, the girder beam 138 is propped up on the vehicle 170 (e.g., is resting on supports at ends of the girder beam 138), so that a gap exists below a bottom of the girder beam 138 and a bed of the vehicle 170. This permits the cradle 102 to more easily be coupled around the girder beam 138.

With reference to FIGS. 15-20, once the cradle 102 has been coupled to the girder beam 138 (e.g., via connection and fastening of two or more frame elements of the cradle 102 around the girder beam 138), the lift assembly 54 then raises the girder beam 138 up toward the roof 190. As illustrated in FIGS. 15-20, during the process of raising the girder beam 138, the new girder beam 138 is rotated approximately 90 degrees from its initial position on the vehicle 170, such that a portion of the girder beam 138 is moved out over the pool 194 (FIG. 18), and away from pipes and ventilation structures in the building 154. In the illustrated construction, the cradle 102 is coupled to the girder beam 138 generally at a center of gravity of the girder beam 138. Thus, the girder beam 138 generally remains stable as it rotates.

In some constructions, a rope or set of ropes or other lines are used to facilitate the rotation of the girder beam 138. For example, one or more operators in the building 154 may attach a rope or ropes to an end of the girder beam 138, and pull on the ropes to cause the girder beam 138 to rotate. As noted above, in some constructions the cradle attachment element 86 is a swivel element. Thus, when the operators pull on the rope or ropes, the girder beam 138 and the cradle 102 swivel and rotate about the cradle attachment element 86. In some constructions, a portion of the lift assembly 54 (e.g., the cradle attachment element 86) includes a motor, linkages, actuators, or other elements that force the rotation of the girder beam 138, or assist in the rotation of the girder beam 138 as the girder beam 138 is being raised.

With continued reference to FIGS. 15-20, while the girder beam 138 is being rotated and raised, the installation jib 14 is also moved (via its own sets of rollers 30, 34, 38) linearly along the top of the existing girder beams 134. In some constructions the installation jib 14 includes a motor or other prime mover that assists in this linear movement. In other constructions the installation jib 14 is manually pulled or otherwise moved linearly along the top of the girder beams 134.

During use of the installation jib 14, the second sub-frame element 46 and the second set of rollers 34 provide support under the girder beam 134 to counteract the torque applied to the installation jib 14 by the weight of the girder beam 138 being raised. As noted above, in some constructions the counterweight structure 126 additionally alleviates or otherwise counterbalances some of the stress and torque applied to the installation jib 14 by the weight of the girder beam 138 being raised.

Figure 21:
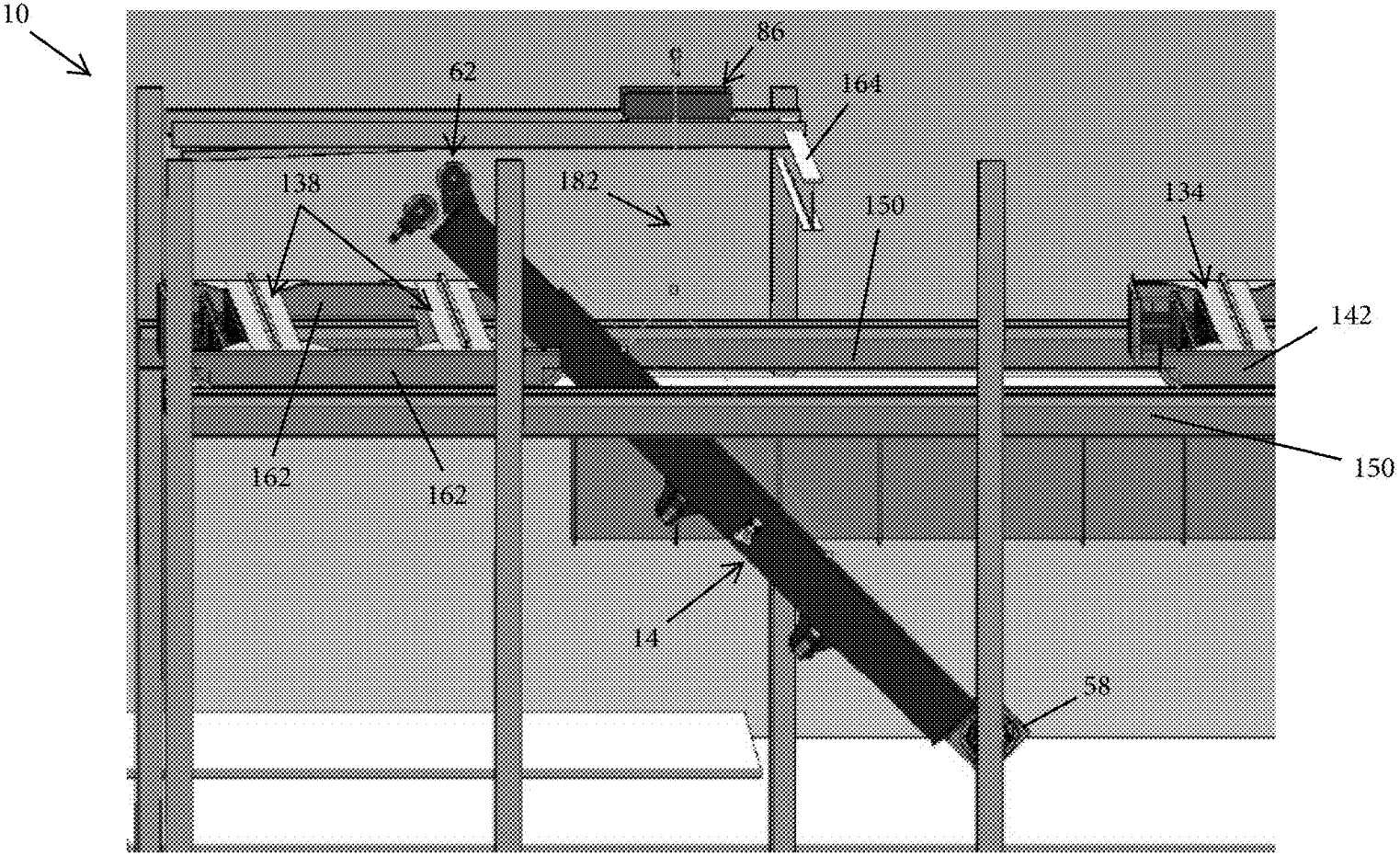
FIGS. 21-24 are perspective views of a process of moving the installation jib off of the existing girder beams and onto the new girder beams.

Once the girder beam 138 has been raised, the girder beam 138 is coupled to the new end trucks 162 (in FIG. 21). The installation jib 14 is then used in a similar manner to raise a second new girder beam 138, and the second new girder beam 138 is coupled to the new end trucks 162.

Figure 22:
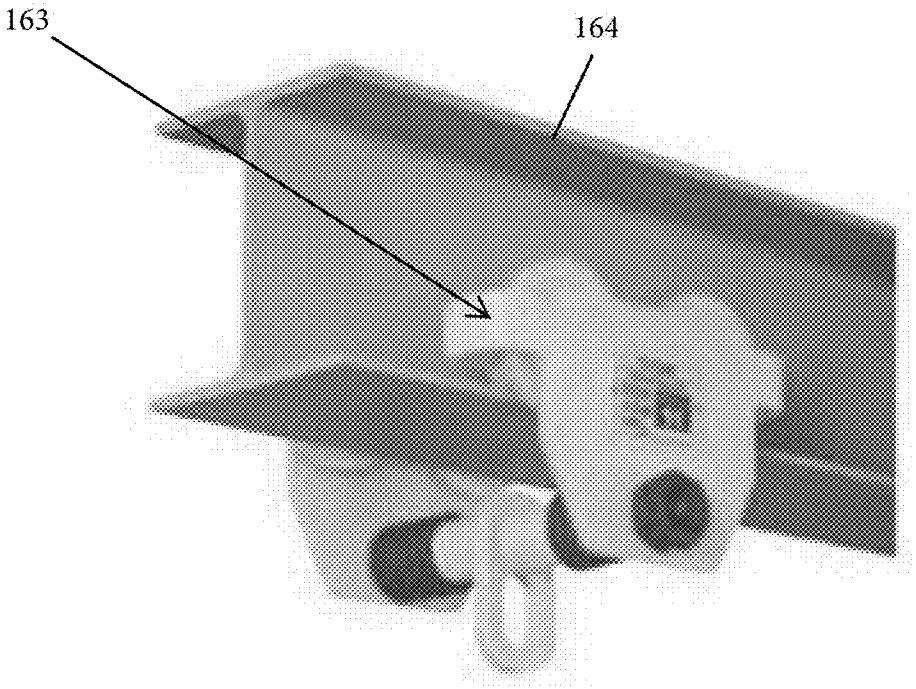
Figure 23:
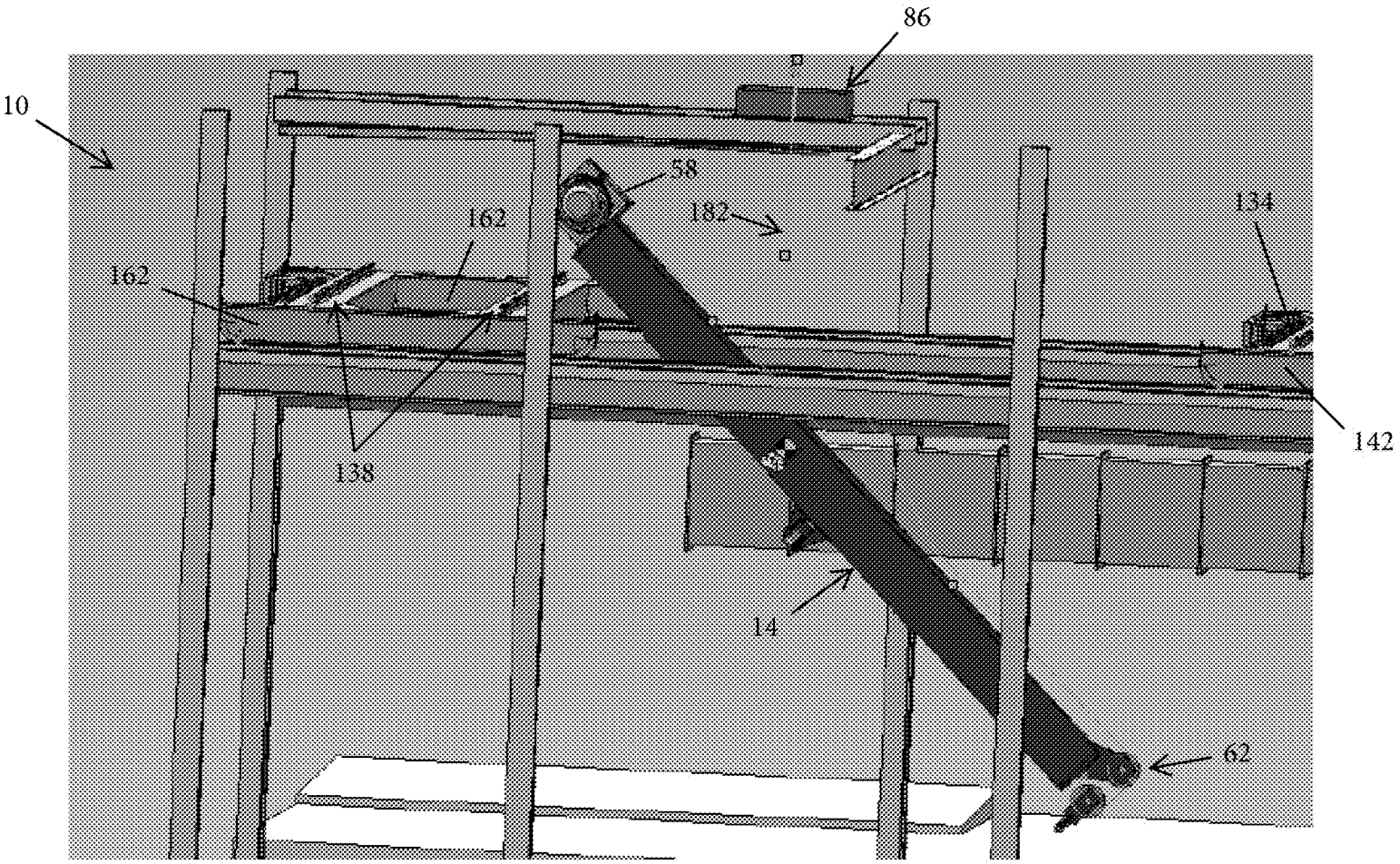

With reference to FIGS. 21 and 22, once the two new girder beams 138 have been coupled to the two new end trucks 162, the installation jib 14 is then removed from the girder beams 134 it is currently mounted to, rotated 180 degrees, and coupled to the new girder beams 138. For example, as illustrated in FIG. 21, the third sub-frame element 50 is first removed from the main body 18 (e.g., manually via an operator). The cradle 102 is also removed. The girder beams 134 and the attached installation jib 14 are then moved via the rollers 146 on the end trucks 142 to a position underneath the hatch 186, so that the rigging 182 may again be coupled to the installation jib 14. The mobile crane 166 then lifts the installation jib 14 up off of the girder beams 134, and the girder beams 134 are moved via the rollers 146 away from the suspended installation jib 14. While the installation jib 14 is suspended via the rigging 182, the installation jib 14 is rotated 180 degrees. In some constructions this is again accomplished via an operator or operators pulling on ropes that are attached to the installation jib 14. In other constructions a motor, linkage, actuator, or other element may be used to cause the rotation or assist with the rotation.

As illustrated in FIGS. 21 and 22, in some constructions the 180 degree movement also includes initially tilting the installation jib 14 (e.g., due to space constraints, and fitting the installation jib 14 between the girder beams 134, 138). For example, the installation jib 14 is first tilted and lowered to a space below the existing and new girder beams 134, 138. The installation jib 14 is then rotated 180 degrees. The installation jib 14 is then raised and tilted again to rise up between the girder beams 134, 138. In some constructions, come-alongs are used to help facilitate the tilting and/or 180 degree movement of the installation jib 14.

Figure 24:
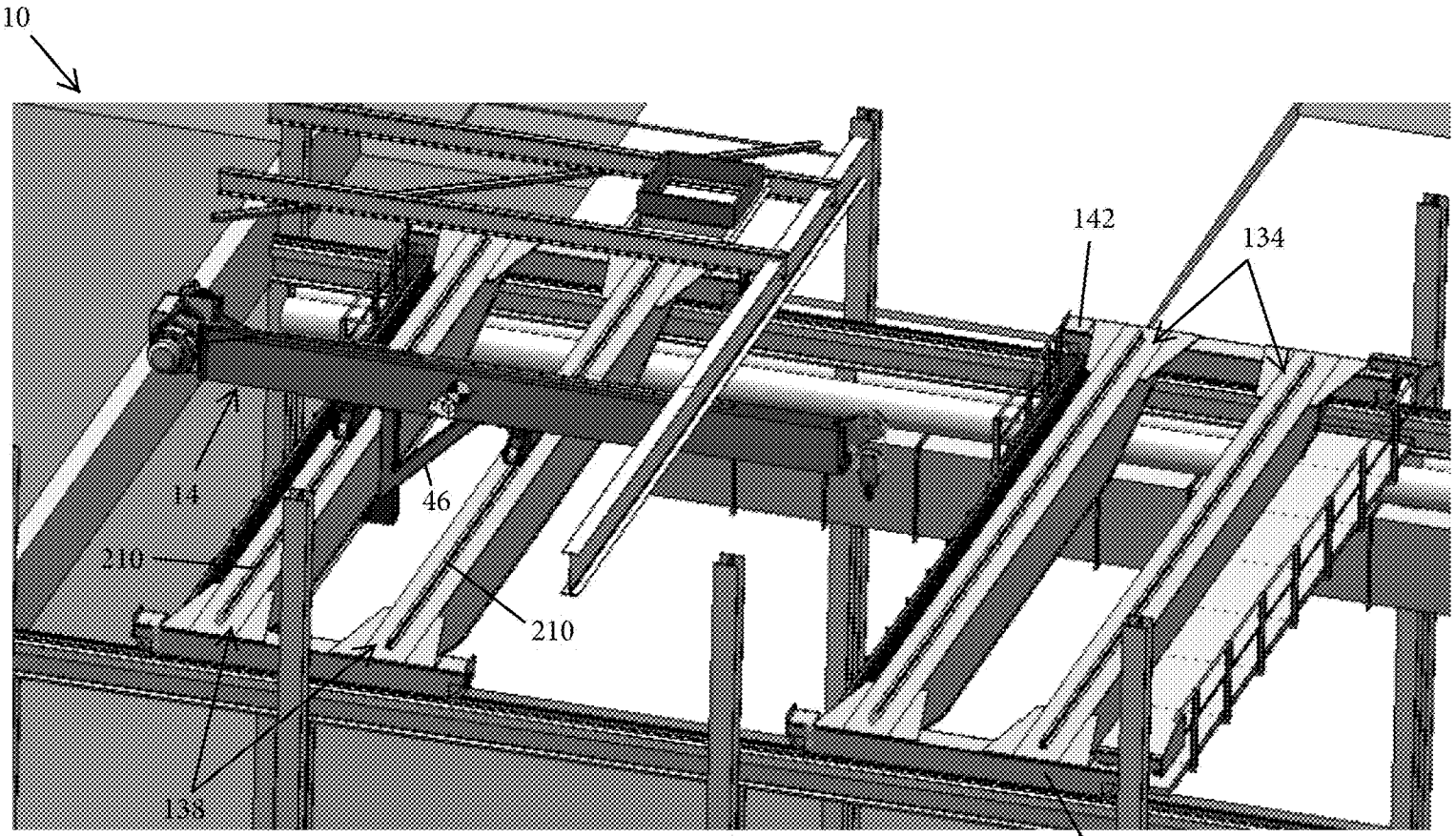

With reference to FIG. 24, once the installation jib 14 has been rotated 180 degrees, the installation jib 14 is then coupled to the girder beams 138. For example, in the illustrated construction, the installation jib 14 is lowered onto the girder beams 138 until the first and third sets of rollers 30, 38 rest on top of upper surfaces or rails 210 of the new girder beams 138. The second sub-frame element 46 is then re-attached to the main body 18, such that the second set of rollers 34 are pressed against a bottom surface and/or rail of one of the girder beams 138.

Figure 25:
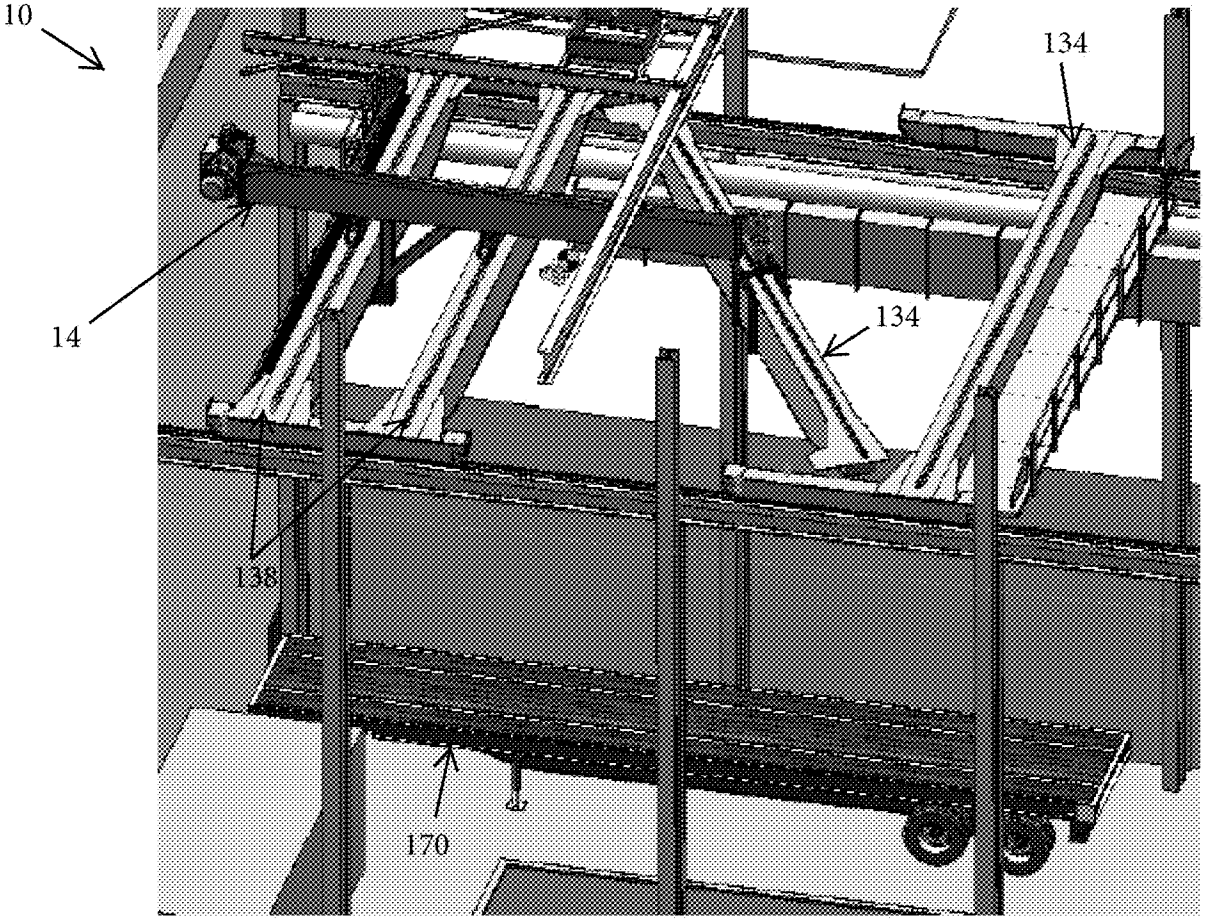
FIGS. 25 and 26 are perspective views of a process of using the installation jib to remove the existing girder beams.
Figure 26:
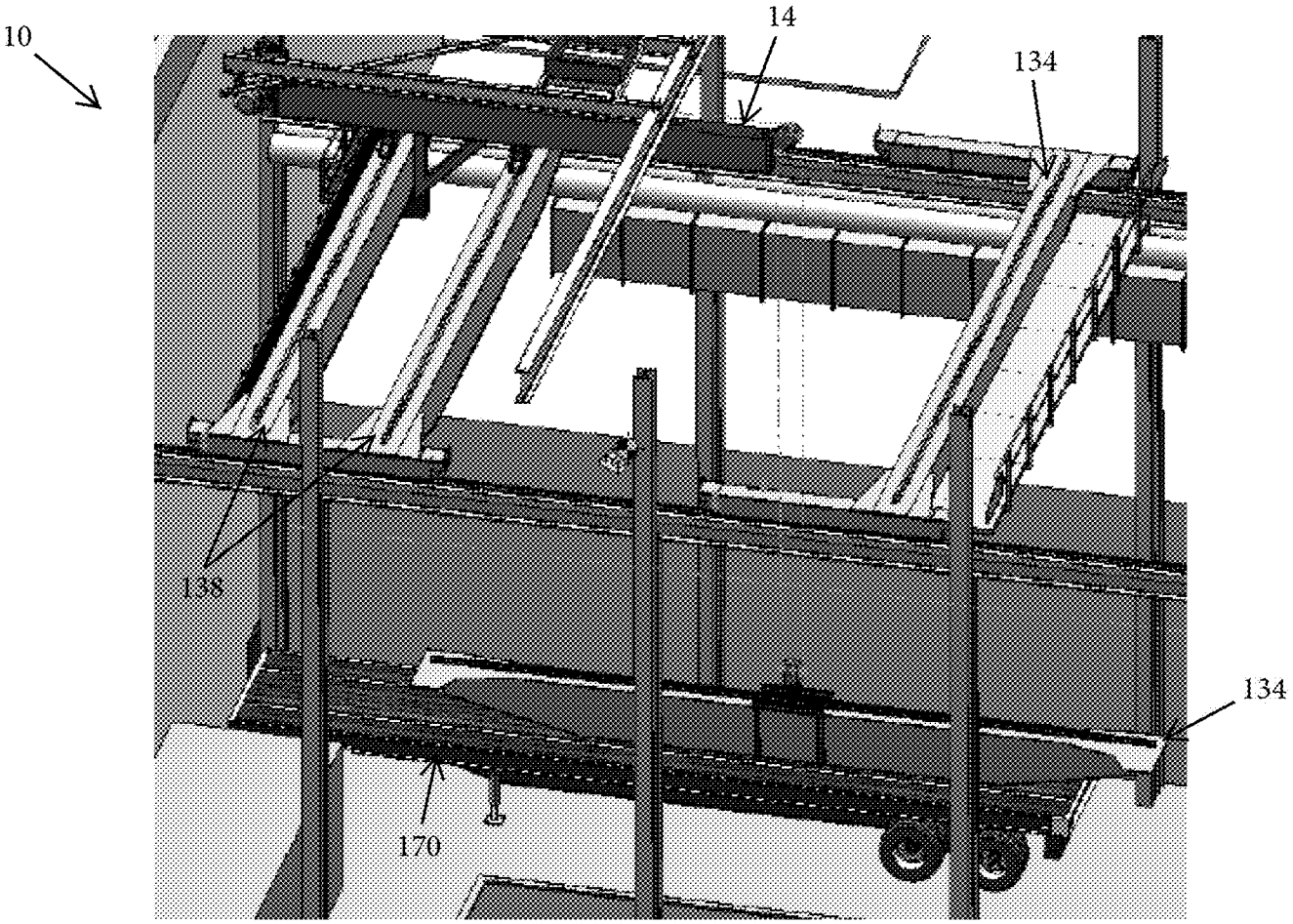

With reference to FIGS. 24-26, the installation jib 14 is then used to remove the existing girder beams 134. For example, the girder beams 138 and the attached installation jib 14 are moved (via rollers on the new end trucks 162) along the rails 150 of the building 154 until the lift block 62 is positioned near one of the girder beams 134. The cradle 102 is re-attached to the cradle attachment element 86, and is lifted via the lift assembly 54. The cradle 102 is then coupled to one of the girder beams 134 (e.g., in a similar manner to how the cradle 102 was coupled to one of the girder beams 138). Once the cradle 102 has been coupled to the girder beam 134 (and the girder beam 134 has been detached from the end trucks 142), the girder beam 134 is lowered down to the vehicle 170. As illustrated in FIGS. 25 and 26, during this process the existing girder beam 134 is rotated approximately 90 degrees. In some constructions, and as described above, the lift assembly 54 itself (e.g., the cradle attachment element 86) includes a motor, linkages, actuators, or other elements that force the rotation of the girder beam 134, or assist in the rotation of the girder beam 134 as the girder beam 134 is being lowered.

While the girder beam 134 is being rotated and lowered, the installation jib 14 is also moved (via its own sets of rollers 30, 34, 38) linearly along the rails 210 of the girder beams 138. As noted above, in some constructions the installation jib 14 includes a motor or other prime mover that assists in this linear movement. In other constructions the installation jib 14 is manually pulled or otherwise moved linearly along the top of the girder beams 138.

With continued reference to FIGS. 24-26, once the first of the existing girder beams 134 has been removed and lowered down onto the vehicle 170, the installation jib 14 is then used to remove and lower the remaining girder beam 134. The process for removing the second girder beam 134 is identical to the process for removing the first girder beam 134. Thus, the cradle 102 is coupled around the second girder beam 134 and the second girder beam 134 is lowered, rotated, and placed onto the vehicle 170 (e.g., adjacent the first existing girder beam 134).

Once both girder beams 134 have been removed and lowered onto the vehicle 170, the existing end trucks 142 are then also removed. In some constructions, the installation jib 14 is used to lift and/or lower the end trucks 142 off of the rails 154 and down to the ground surface 198 or to the vehicle 170. In other constructions, the mobile crane 166 and rigging 182 are used to lift and/or lower the end trucks 142. In yet other constructions, a different structure or structures (e.g., a beam trolley or trolleys) is used to lift and/or lower the existing end trucks 142. In some constructions, the associated walkways 158 are also removed and lowered via the installation jib 14, the mobile crane 166, or a different crane.

Once the end trucks 142 and associated walkways 158 have been removed, the installation jib 14 is then lowered back down to the ground surface 198 or to the vehicle 170. For example, the rigging 182 is again coupled to the installation jib 14, and the second sub-frame element 46 is detached from the main body 18. The cradle 102 is also detached. The mobile crane 166 then lifts the installation jib 14 off of the girder beams 138, and lowers the installation jib 14 back down to the ground surface 198 or to the vehicle 170. During this process the installation jib 14 is rotated or swiveled 90 degrees (e.g., via the cradle attachment element 86), so that the installation jib 14 aligns with the vehicle 170.

In some constructions, once the installation jib 14 has been removed from the new girder beams 138, a new trolley (not illustrated) is raised (e.g., with the mobile crane 166) and coupled to the new girder beams 138.

By using the installation jib 14 to add and remove the girder beams 134, 138, and by using the girder beams 134, 138 to support trolleys and hoists, the limited floor space of the ground surface 198 within the building 154 is preserved. Additionally, the ground surface 198 may be kept free from large-scale equipment that may otherwise be too large or heavy for the ground surface 198.

As described above, the installation jib 14 may include various other shapes, sizes, and configurations. For example, and with reference to FIGS. 27 and 28, in some constructions, a fourth sub-frame element 168 is provided on the installation jib 14. The fourth sub-frame element 168 (which may have a similar but mirrored shape to the third sub-frame element 50) extends down from the main body 18, such that a fourth set of rollers 172 coupled to the fourth sub-frame element 168 are positioned under and contact a bottom of the other existing girder beam 134.

Figure 27:
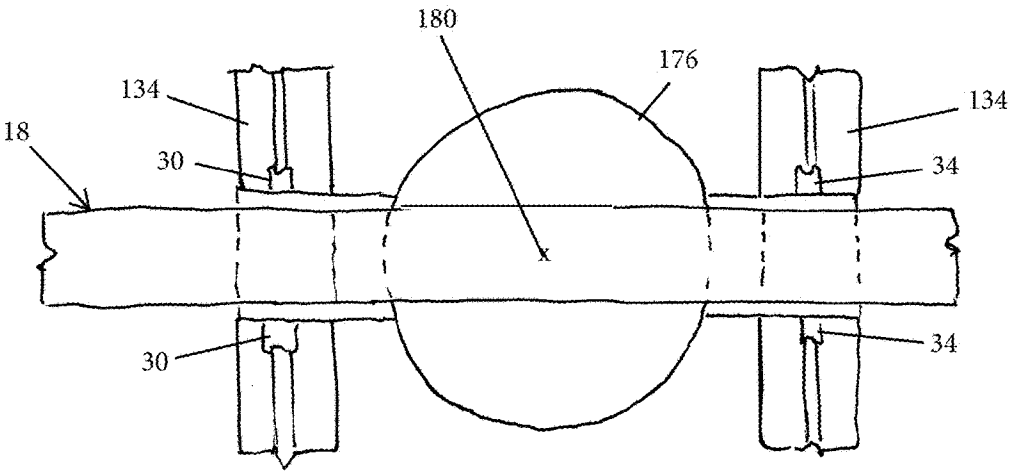
FIGS. 27 and 28 are schematic views of the installation jib, illustrating a fourth sub-frame element and rotation of the main body.
Figure 28:
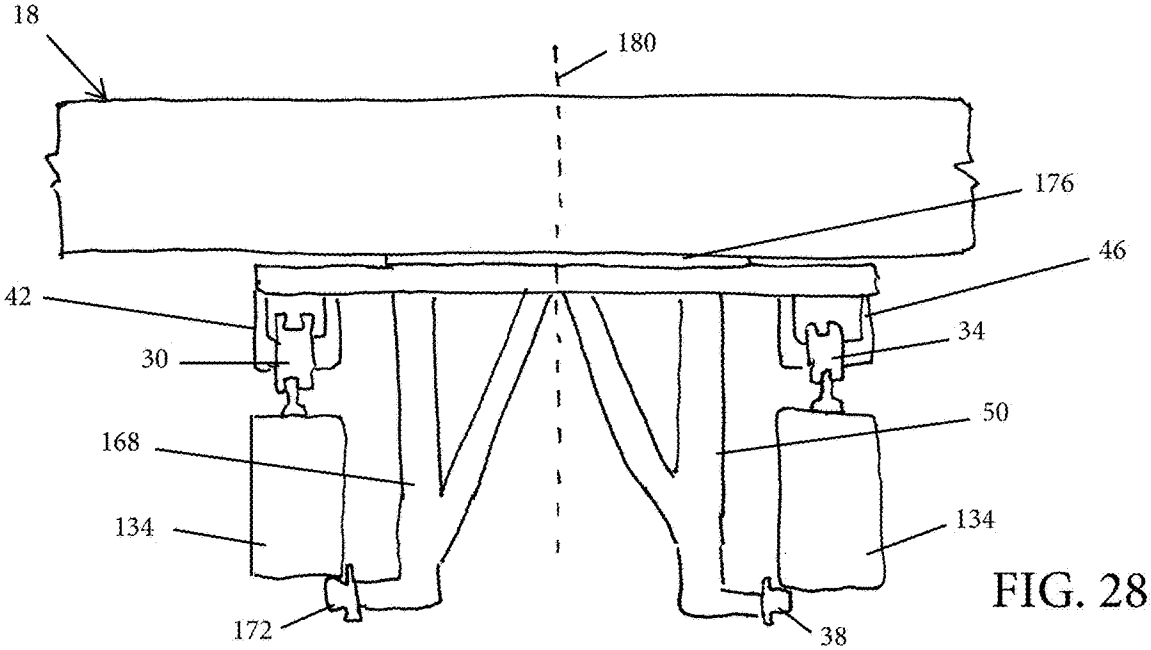

With continued reference to FIGS. 27 and 28, in some constructions, the main body 18 is rotatable relative to the sub-frame elements 42, 46, 50, and/or 168. For example, in the illustrated construction, the installation jib 14 includes at least one rotation element 176 (e.g., rotation table, plate, bearing, set of rollers, race, turret, hinge, etc.) disposed between the main body 18 and the sub-frame elements 42, 46, 50, 168 that allows the main body 18 to rotate (e.g., at least 45 degrees, at least 90 degrees, at least 180 degrees, at least 360 degrees, etc.). The main body 18 rotates about an axis 180 (e.g., vertical axis) that extends down and between the third and fourth sub-frame elements 50, 168. Rotation of the main body 18 allows the main body 18 to be moved as needed to accommodate other hoists or equipment, and also for the lift block 62 to be moved to a desired location to raise various components.

Figure 29:
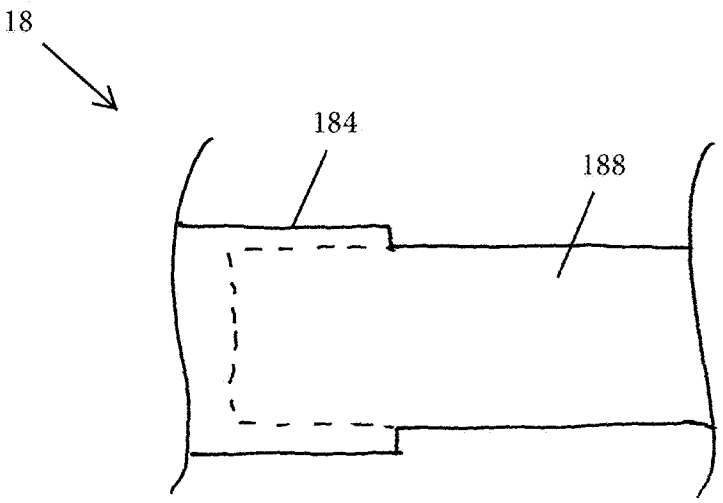
FIG. 29 is a schematic view of the installation jib, illustrating telescoping portions.

With reference to FIG. 29, in some constructions, the main body 18 includes two or more telescoping portions 184, 188. The telescoping portions 184, 188 may be adjusted relative to one another to change an overall length of the main body 18, and for example to move the lift block 62 to a desired location to pick up materials.

Figure 30:
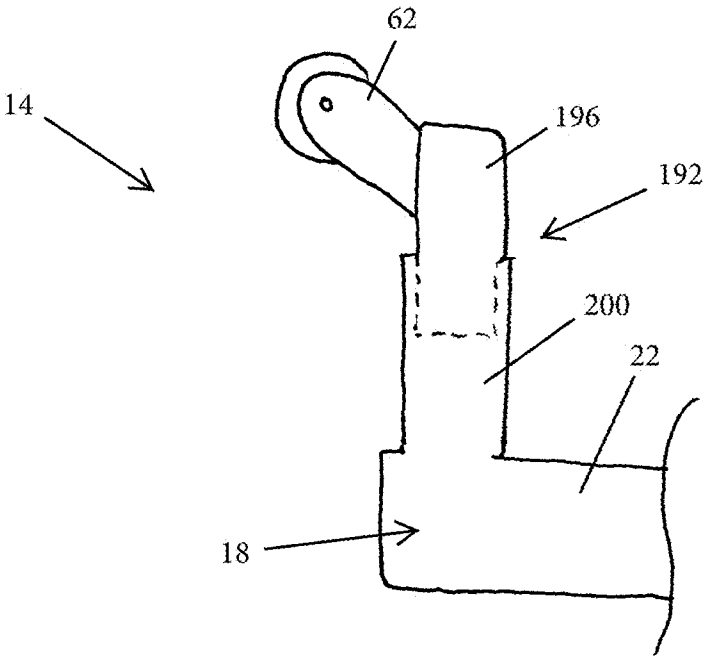
FIG. 30 is a schematic view of the installation jib, illustrating a telescoping mast.

With reference to FIG. 30, in some constructions, the installation jib 14 includes a mast 192 (e.g., vertically extending mast and/or telescoping mast), that extends perpendicularly from the main body 18, or at other angles from the main body 18, to serve as a lifting mechanism off of the main body 18. As illustrated in FIG. 30, in some constructions the mast 192 extends from the first end 22 of the main body 18 and includes a first telescoping portion 196 and a second telescoping portion 200. The lifting block 62 is coupled to the first telescoping portion 196. The telescoping portions 196, 200 allow a height of the mast 192 to be adjusted, and thus a height of the lifting block 62 to be adjusted.

Although the invention has been described in detail with reference to certain preferred constructions, variations and modifications exist within the scope and spirit of one or more independent aspects of the invention as described.

What is claimed is:

1. An installation jib for a girder beam installation and removal system, the installation jib comprising:

a main body having a first end and a second, opposite end, the main body extending along a longitudinal axis between the first end and the second end;

a first sub-frame element coupled to the main body;

a first roller coupled to the first sub-frame element;

a second sub-frame element coupled to the main body; and a second roller coupled to the second sub-frame element;

wherein the first sub-frame element and the second sub-frame element are spaced longitudinally apart from one another and spaced longitudinally apart from the first end and the second end of the main body, wherein the first roller and the second roller each are configured to rotate about an axis that is parallel to the longitudinal axis.

2. The installation jib of claim 1, further comprising a third sub-frame element coupled to the main body and a third roller coupled to the third sub-frame element, wherein the third sub-frame element is removably coupled to the main body.

3. The installation jib of claim 2, wherein at least a portion of the third sub-frame element is disposed longitudinally between the first sub-frame element and the second sub-frame element.

4. The installation jib of claim 2, wherein the third roller is positioned below the second roller, such that a plane that passes through the longitudinal axis also passes through both the second roller and the third roller.

5. The installation jib of claim 1, wherein a prime mover is coupled to the second end of the main body.

6. The installation jib of claim 5, wherein a lift block is coupled to the first end of the main body, and wherein the lift block is coupled to the prime mover.

7. The installation jib of claim 1, wherein the first sub-frame element and the second sub-frame element each extend downward from the main body.

8. The installation jib of claim 1, wherein the main body includes telescoping portions.

9. The installation jib of claim 1, wherein the main body is configured to rotate.

10. An installation jib for a girder beam installation and removal system, the installation jib comprising:

an elongate main body having a first end and a second, opposite end, the main body extending along a longitudinal axis between the first end and the second end;

a plurality of sub-frame elements and rollers coupled to the main body between the first end and the second end, each of the sub-frame elements including at least one roller;

a prime mover coupled to the second end; and a lift block coupled to both the first end and to the prime mover.

11. The installation jib of claim 10, wherein the lift block includes a first pulley support extending from the first end of the main body, a first pulley coupled to the first pulley support, a second pulley support spaced from the first end of the main body, and a second pulley coupled to the second pulley support, wherein a line extends from the prime mover around both the first pulley and the second pulley.

12. The installation jib of claim 11, wherein a swivel element is coupled to the second pulley support.

13. The installation jib of claim 10, wherein the lift block includes at least one pulley, and wherein a line extends from the prime mover to the at least one pulley.

14. The installation jib of claim 10, wherein at least a portion of the lift block is integrally formed as a single piece with the first end of the main body.

15. The installation jib of claim 10, further comprising a cradle coupled to the lift block, wherein the cradle includes at least one frame element configured to support a girder beam.

16. The installation jib of claim 15, wherein the cradle includes a plurality of frame elements that together form U-shaped frame structure for supporting a girder beam.

17. The installation jib of claim 15, wherein the lift block includes a swivel element releasably coupled to the cradle.

* * * * *